US007513706B2

(12) United States Patent
Kimura et al.

(10) Patent No.: US 7,513,706 B2
(45) Date of Patent: Apr. 7, 2009

(54) PRINTING APPARATUS

(75) Inventors: Satoshi Kimura, Ome (JP); Yoshiaki Mochizuki, Mizuho-machi (JP); Katsuyuki Matsuo, Hanno (JP); Ryoichi Furukawa, Kokubunji (JP); Chihiro Fujishima, Musashimurayama (JP)

(73) Assignee: Casio Computer Co., Ltd., Tokyo (JP)

( * ) Notice: Subject to any disclaimer, the term of this patent is extended or adjusted under 35 U.S.C. 154(b) by 526 days.

(21) Appl. No.: 11/249,102

(22) Filed: Oct. 12, 2005

(65) Prior Publication Data

US 2006/0078366 A1 Apr. 13, 2006

(30) Foreign Application Priority Data

Oct. 13, 2004 (JP) ..... 2004-299323
Sep. 29, 2005 (JP) ..... 2005-283526

(51) Int. Cl.
*B41J 29/00* (2006.01)
*B41J 3/407* (2006.01)

(52) U.S. Cl. ..... 400/693; 400/120.01

(58) Field of Classification Search ..... None
See application file for complete search history.

(56) References Cited

U.S. PATENT DOCUMENTS

| | | | | |
|---|---|---|---|---|
| 5,542,768 | A | 8/1996 | Rother et al. | |
| 6,148,722 | A | 11/2000 | Hagstrom | |
| 6,249,303 | B1 * | 6/2001 | Mochizuki et al. | 347/222 |
| 6,302,601 | B1 | 10/2001 | Hagstrom et al. | |
| 6,580,444 | B1 | 6/2003 | Drynkin et al. | |
| 6,709,175 | B1 | 3/2004 | Drynkin et al. | |
| 6,857,797 | B2 | 2/2005 | Weast | |
| 2003/0142199 | A1 | 7/2003 | McFarland et al. | |
| 2004/0265032 | A1 | 12/2004 | Furihata et al. | |
| 2006/0078364 | A1 | 4/2006 | Kimura et al. | |

FOREIGN PATENT DOCUMENTS

| | | | |
|---|---|---|---|
| EP | 1 332 884 | A2 | 8/2003 |
| EP | 1 468 835 | A1 | 10/2004 |
| JP | 06199332 | A * | 7/1994 |
| JP | 07-314747 | A | 12/1995 |
| JP | 10309859 | A * | 11/1998 |

(Continued)

OTHER PUBLICATIONS

Machine translation of JP 10309859 to Isobe from Japanese Patent Office website.*

(Continued)

*Primary Examiner*—Daniel J Colilla
(74) *Attorney, Agent, or Firm*—Frishauf, Holtz, Goodman & Chick, P.C.

(57) ABSTRACT

A main body has a receiving section, which contains an ink ribbon cassette holding an ink ribbon, together with an optical disk. The ink ribbon and the optical disk are fed by a platen roller, and printing is performed on the optical disk through a thermal head. The optical disk is inserted from an insertion port at a side of the main body parallel to the feed direction of the ink ribbon. When the optical disk is inserted from an ejection port in a direction orthogonal to the fed direction of the ink ribbon, an insertion-prevention member prevents the insertion of the optical disk.

10 Claims, 22 Drawing Sheets

FOREIGN PATENT DOCUMENTS

| | | | | |
|---|---|---|---|---|
| JP | 2000155867 | A | * | 6/2000 |
| JP | 2003-072173 | A | | 3/2003 |
| JP | 2003-072175 | A | | 3/2003 |
| JP | 2003266876 | A | * | 9/2003 |
| WO | WO 00/63020 | A1 | | 10/2000 |

OTHER PUBLICATIONS

Machine translation of JP 2000155867 to Kosuda et al. from Japanese Patent Office website.*

* cited by examiner

PRINTING APPARATUS

BACKGROUND OF THE INVENTION

1. Field of the Invention

The present invention relates to a printing apparatus and a printing method for printing information like a title of data recorded in a recording medium on the top side of that recording medium such as a CD-R (Compact Disk Recordable), a CD-RW (Compact Disk Rewritable), a DVD-R (Digital Versatile Disk Recordable), or DVD-RW (Digital Versatile Disk Rewritable).

2. Description of the Related Art

There has been proposed a printing apparatus which performs printing on the label of a recording medium, such as an optical disk. Unexamined Japanese Patent Application KOKAI Publication JP 2003-72173 discloses a printing apparatus which performs printing on an optical disk.

The printing apparatus comprises a tray which supports an optical disk, and a printing mechanism which performs printing on the optical disk supported by the tray. The tray is so provided as to be movable between the interior of a main body and the exterior thereof. The printing mechanism has a carriage which is movable inside the main body. A thermal head is mounted on the carriage, and the carriage has an ink ribbon cassette which contains an ink ribbon for thermal transfer printing and a ribbon feeding mechanism which feeds the thermal head with the ink ribbon.

The printing apparatus is so structured that the tray is moved out of the main body for mounting of an optical disk on the tray, the tray supporting the optical disk is moved toward the interior of the main body and set at a predetermined position where printing is performed on the optical disk, and the thermal head which is mounted on the carriage and moves performs thermal transfer printing on the optical disk set at the predetermined position using the ink ribbon.

In the printing apparatus, however, a direction in which the tray having the optical disk mounted thereon is moved toward the interior of the main body to set the tray at the predetermined position in the main body is orthogonal to the direction of movement of the carriage in the printing mechanism in the main body and the feed direction of the ink ribbon. Accordingly, when the optical disk is inserted into the main body, the ink ribbon fed out from the ink ribbon cassette and running around the thermal head may be caught by the optical disk being inserted into the main body, and twisted or damaged.

In particular, if the ink ribbon is loosened when the ink ribbon cassette is attached to the carriage, or if the ink ribbon is loosened by the head-up action of the thermal head, the ink ribbon is caught by the optical disk more easily, and is more likely to be damaged. Twisting and damage of the ink ribbon originating from the insertion of the optical disk causes troubles, such as a trouble in feeding the ink ribbon and improper printing.

SUMMARY OF THE INVENTION

The present invention has been made in view of those problems, and it is an object of the invention to provide a printing apparatus which prints information, such as a sequence of character, onto a print target inserted into a main body from outside by thermally transferring the ink of an ink ribbon, and prevents troubles like twisting and damaging of the ink ribbon by the print target when the print target is inserted, thereby avoiding improper feeding of the ink ribbon, improper printing, or the like.

To achieve the object, a printing apparatus according one aspect of the invention comprises a main body into which a print target is inserted, a printing section, provided in the main body, which thermally transfers ink of an ink ribbon onto the print target, a feeder, provided in the main body, which feeds the printing section with the ink ribbon, wherein the main body has an insertion port which aligns a print surface of the print target with an ink surface of the ink ribbon from outside the main body toward the printing section therein, and into which the print target is insertable only in a direction parallel to a feed direction of the ink ribbon by the feeder.

According to the above-described structure, in inserting the print target from the insertion port of the main body, the print target moves toward the printing section in parallel with the feed direction of the ink ribbon, and for this reason, the ink ribbon is not twisted and damaged, thus preventing improper ribbon feeding and improper printing at the time of printing.

In the structure, the printing apparatus further includes a guide section, provided in the main body, which aligns the print surface of the print target inserted into the main body from the insertion port with the ink surface of the ink ribbon, holds the print target in the direction parallel to the feed direction of the ink ribbon by the feeder, and guides the print target to that position where the printing section is provided at.

According to this structure, since the print target is guided and moved by the guide section when inserted into the main body, the print target moves toward the printing section while being more surely kept parallel to the feed direction of the ink ribbon.

In the structure, the main body is provided with an ejection port from which the print target inserted into the main body is ejectable out of the main body at that position orthogonal to the feed direction of the ink ribbon by the feeder, and an insertion-prevention section which prevents penetration of the print target inserted from outside the main body toward the main body through the ejection port into the main body.

According to this structure, when the print target is accidentally inserted into the main body from the ejection port provided at the position orthogonal to the feed direction of the ink ribbon, the accidental insertion of the print target is prevented by the insertion-prevention section.

It is desirable that the insertion-prevention section should be provided along the ejection port formed in a slit-like shape along the direction of the guide section, or at least in a vicinity of that position where the printing section is provided at.

In the structure, the insertion-prevention section is pushed by the print target and withdrawn to a position where insertion of the print target into the main body is not interfered when the print target is inserted from the insertion port, and returns to a state where the penetration of the print target from the ejection port is prevented when the print target is ejected from the main body.

According to the structure, the insertion-prevention section prevents the penetration of the print target from the ejection port, and does not interfere the insertion of the print target from the insertion port.

In the structure, the main body has a receiving section which detachably receives an ink-ribbon cassette holding the ink ribbon and receives the print target inserted into the main body in a condition where the print target protrudes outward of the main body, the ejection port is connected to the insertion port, and is provided with an ejection-port cover which covers an opening of the ejection port in an openable and closable manner, becomes an open state when pressed by the print target to protrude the print target from the main body toward outside thereof through the ejection port when the print target is inserted from the insertion port and contained by the receiving section, and returns to a closed state when the print target is ejected out of the main body.

According to this structure, a printing is carried out with the print target protruding outward of the main body and a part of the print target contained, and this results in a miniaturization of the main body of the printing apparatus. The ejection port is normally covered by the ejection-port cover, so that when the print target is inserted from the insertion port, the ejection-port cover opens and the print target reaches to a predetermined position, and when the print target is taken out from the ejection port after the printing, the ejection-port cover is closed to cover the ejection port, thereby preventing dusts from entering in the main body.

In the structure, the main body has a receiving-section cover which covers an opening of the receiving-section in an openable and closable manner, and the receiving-section cover is formed with the ejection port, and is provided with the ejection-port cover and the insertion-prevention section.

This structure makes it possible to provide the ejection port, the ejection-port cover, and the insertion-prevention section on the receiving-section cover which constitutes the main body.

In the structure, the ejection-port cover covers the print surface of the print target protruding outward of the main body when the print target is inserted into the main body and the ejection-port cover becomes open.

This structure permits the printing section to adjust the print position relative to the print target on the basis of the ejection-port cover which covers the print surface of the print target.

In the structure, the ejection-port cover may be made of a transparent material and an alignment mark may be provided on the ejection-port cover, thus facilitating the adjustment of the print target relative to the print position by the printing section.

In the structure, a buffer member may be provided on a portion of the ejection-port cover, making it possible to protect the print target.

A printing apparatus according to another aspect of the invention comprises a printing section which thermally transfers ink of an ink ribbon onto a print target inserted into the printing apparatus, a feeder which feeds the printing section with the ink ribbon, an insertion port for inserting the print target into the printing apparatus from outside the printing apparatus, and a guide section which guides the inserted print target to a print position opposite to the printing section in a direction parallel to a direction of carriage of the ink ribbon by the feeder.

In the above-described structure, it is desirable that the guide section should extend in the feed direction of the ink ribbon from the insertion port so as to pass through the print position, and guide the print target in a direction parallel to the direction of carriage of the ink ribbon from the insertion port while passing through the print position.

In the structure, the carrying section may carry the print target together with the ink ribbon. In this case, the printing apparatus may further include a section which carries the print target together with the ink ribbon in cooperation with the carrying section. The carrying section may lay the ink ribbon on the print target and carry them together.

In the structure, an ejection port for ejecting the print target inserted into the printing apparatus may be provided at a position orthogonal to the direction of carriage of the ink ribbon by the carrying section. In this case, it is desirable that an insertion-prevention member should be provided for preventing penetration of the print target which is inserted from outside the printing apparatus via the ejection port. It is desirable that the insertion-prevention member be withdrawn to that position where ejection of the print target from the ejection port is not prevented when the print target is inserted from the insertion-prevention member.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Preferred embodiments of the present invention will be described below with reference to the accompanying drawings.

Figure 1:
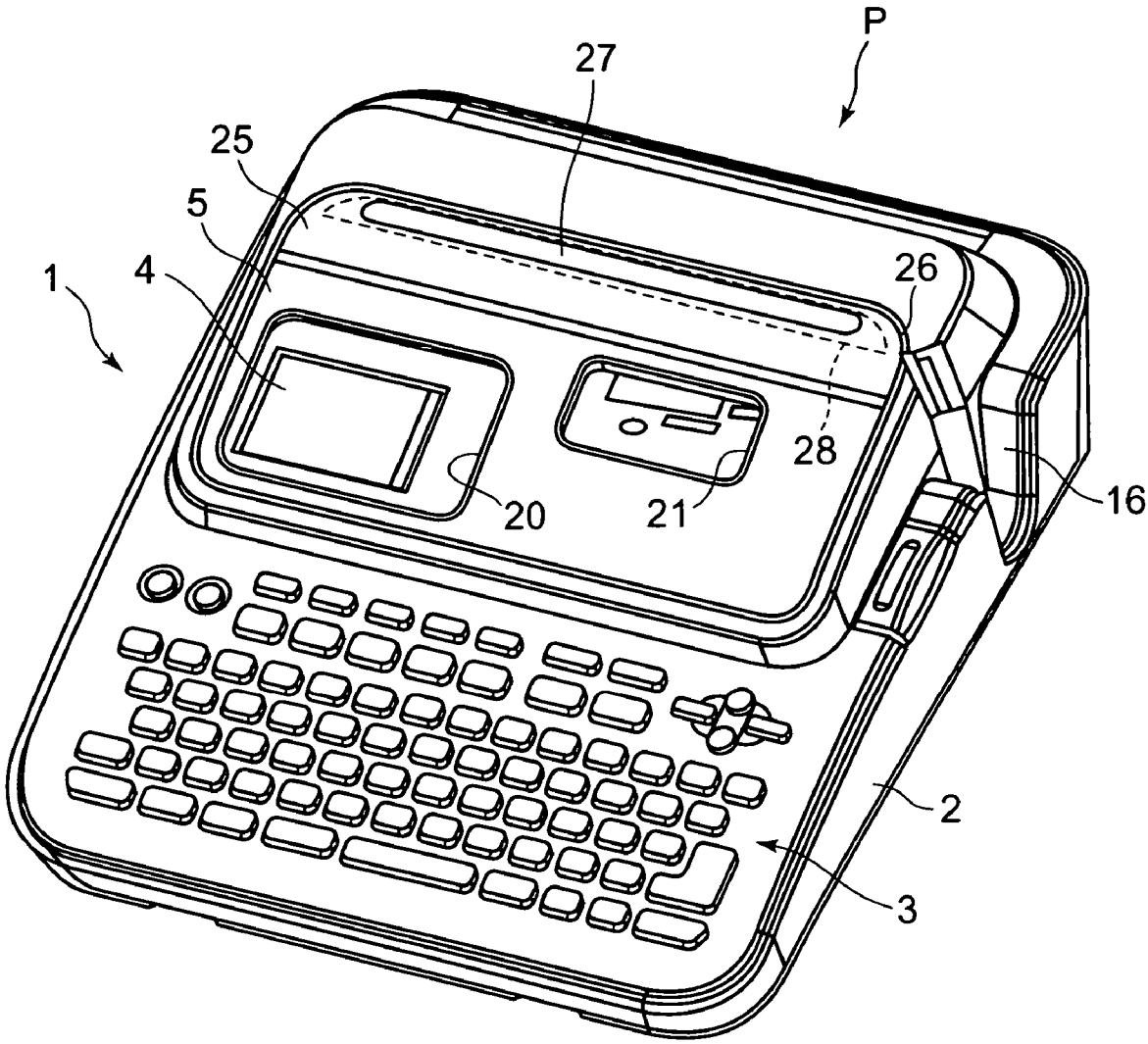
FIG. 1 is a perspective view illustrating a state where a receiving-section cover of a printing apparatus according to one embodiment of the present invention is closed.
Figure 2:
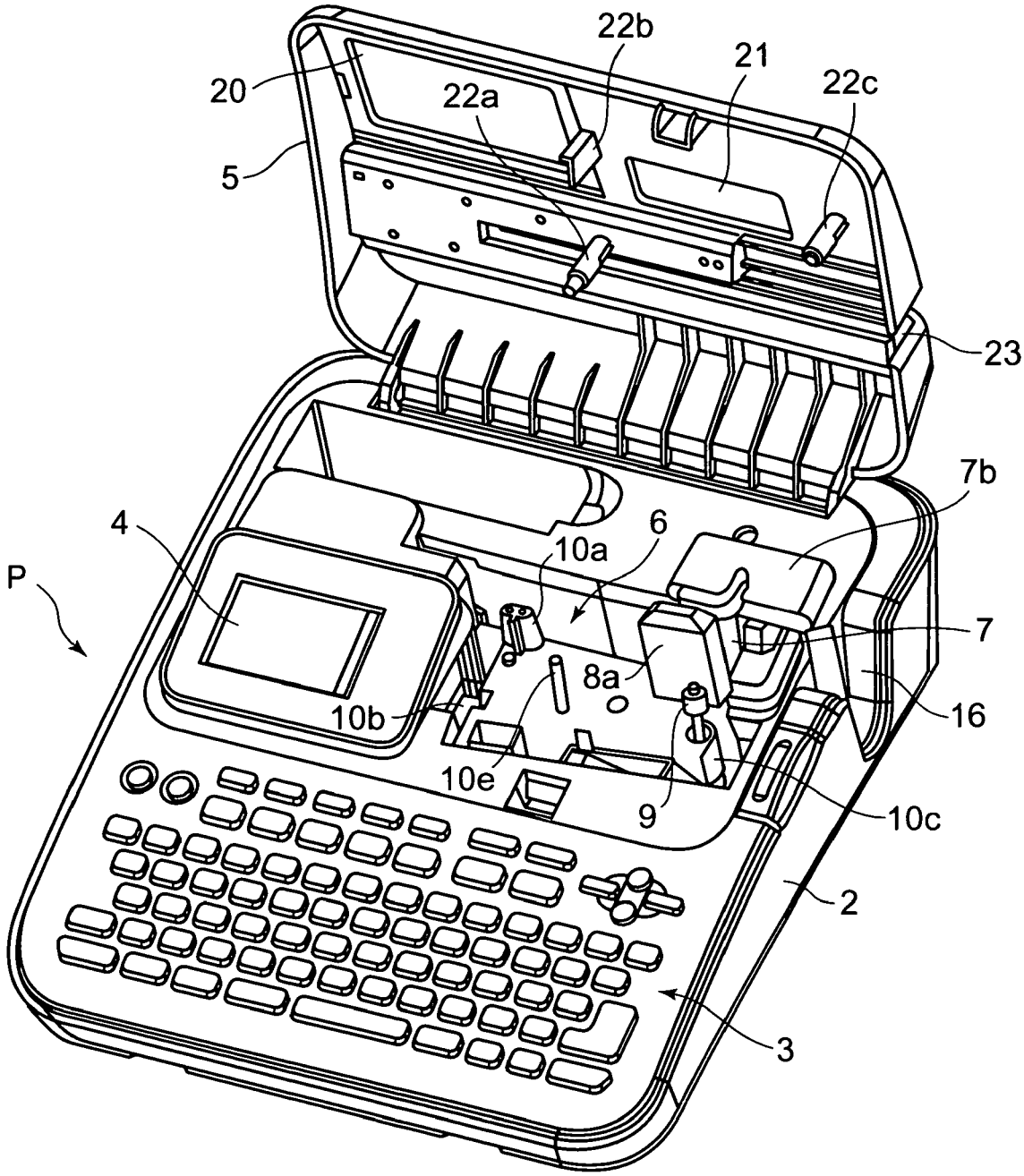
FIG. 2 is a perspective view illustrating the receiving-section cover of the printing apparatus open.
Figure 3:
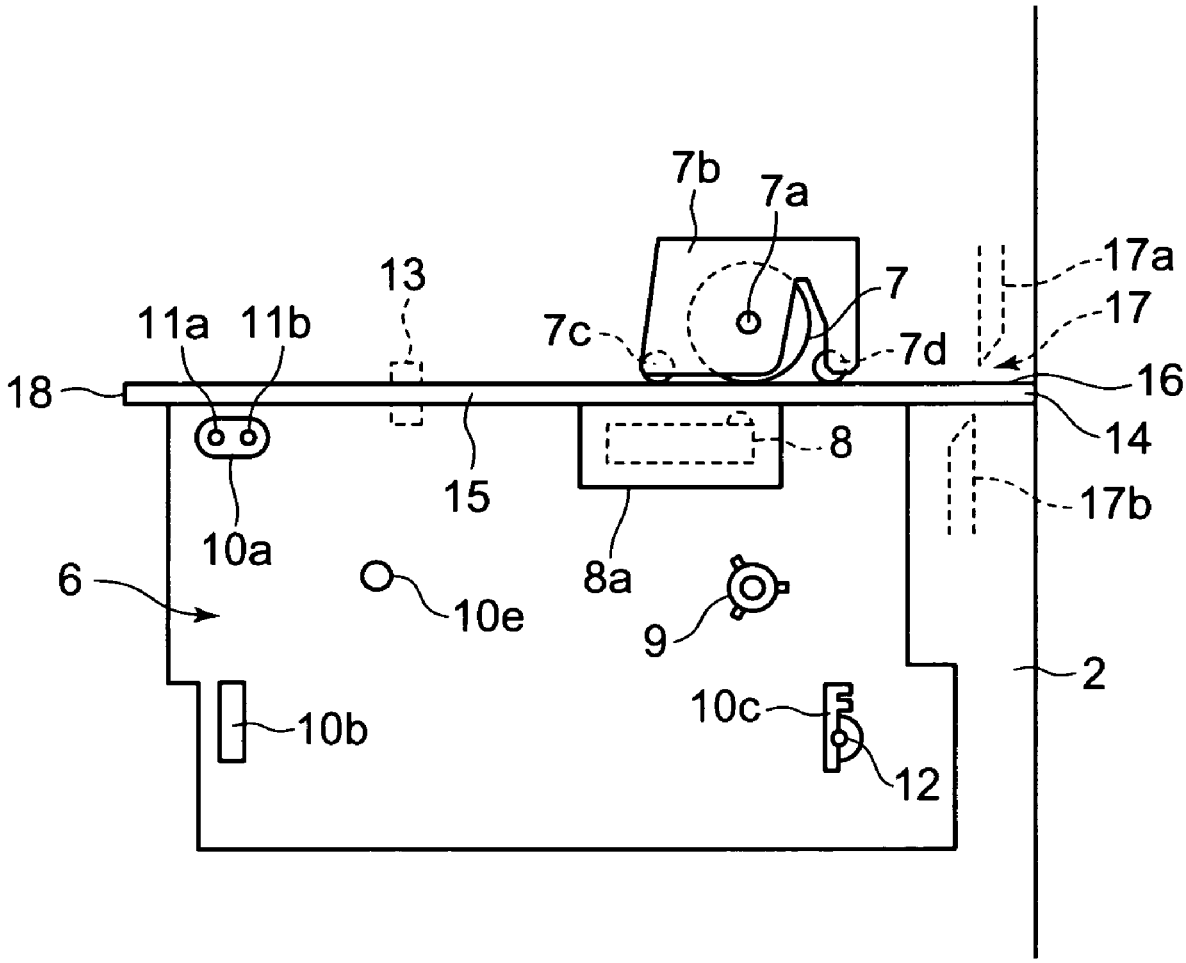
FIG. 3 is a plan view of a receiving section of the printing apparatus.

FIG. 1 is a perspective view illustrating a state where a receiving-section cover of a printing apparatus P according to one embodiment of the present invention is closed, and FIG. 2 is a general perspective view illustrating the receiving-section cover of the printing apparatus P open. FIG. 3 is a plan view of a receiving section provided at the printing apparatus.

The printing apparatus P can print directly on the surface (label side) of an optical recording medium (optical disk), such as a CD-R (Compact Disk Recordable), CD-RW (Compact Disk ReWritable), DVD-R (Digital Versatile Disk Recordable), or DVD-RW (Digital Versatile Disk ReWritable), as well as on a print tape.

As shown in FIG. 1, the printing apparatus P comprises a main body 1 having a body case 2 and a receiving-section cover 5. A key input section 3 and a display section 4 are provided on the top surface of the body case 2 of the main body 1. The key input section 3 has character keys for inputting data of a sequence of characters to be printed on a print tape or an optical disk, a print key to instruct the initiation of printing, cursor keys to move a cursor on the display screen of the display section 4, and various control keys needed for editing a sequence of characters input, various setting processes, a printing process, and the like. The display section 4 is a liquid crystal display apparatus which displays data input from the key input section 3, and setting screens and messages relating to printing.

The body case 2 of the main body 1 has a single receiving section 6 for receiving a cassette and a recording medium. The top surface of the receiving section 6 is open for mounting and dismounting a cassette, and the opening is opened and closed by the receiving-section cover 5 provided on the top surface.

Figure 4A:
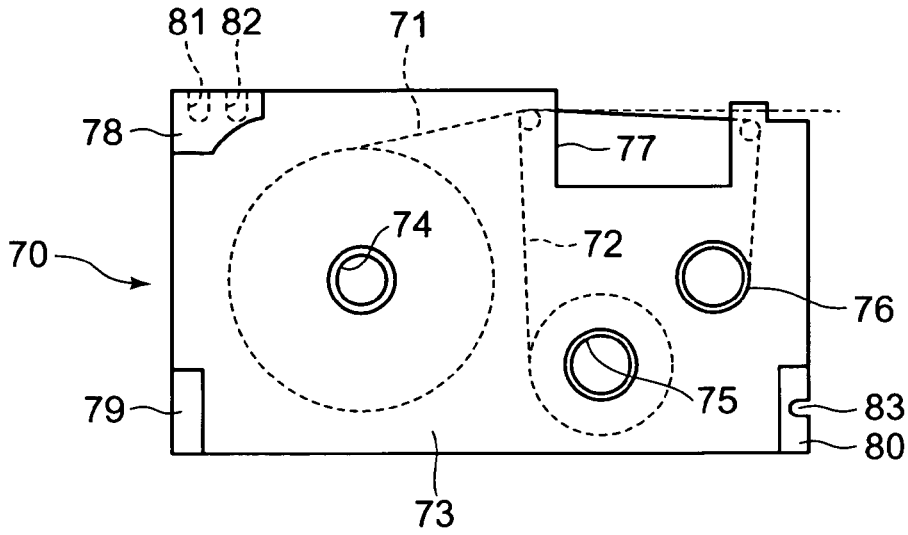
FIG. 4A is a plan view of a tape cassette for use in the printing apparatus.
Figure 4B:
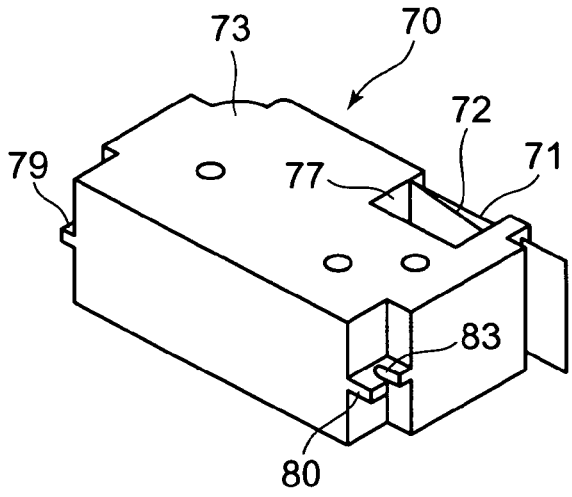
FIG. 4B is a perspective view of the tape cassette for use in the printing apparatus.
Figure 5A:
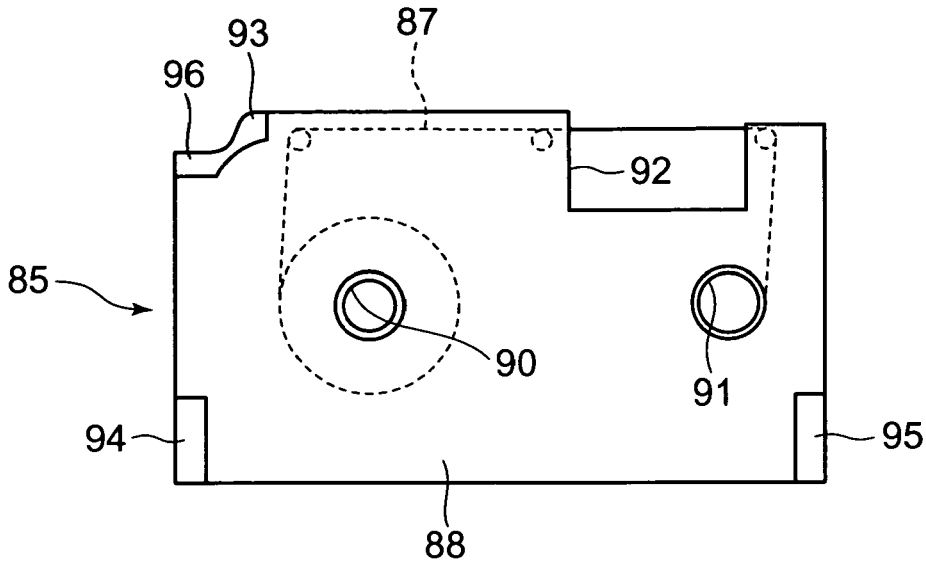
FIG. 5A is a plan view of an ink ribbon cassette for use in the printing apparatus.
Figure 5B:
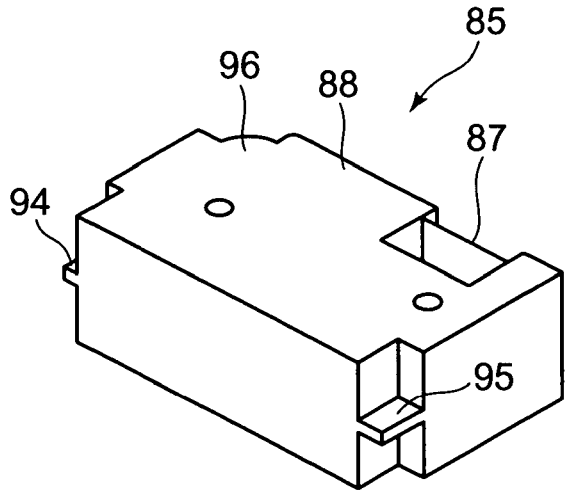
FIG. 5B is a perspective view of the ink ribbon cassette for use in the printing apparatus.

A tape cassette 70, shown in FIGS. 4A and 4B, and an ink ribbon cassette 85, shown in FIGS. 5A and 5B, are selectively received in the receiving section 6. The tape cassette 70 and the ink ribbon cassette 85 have approximately the same outside shapes. The tape cassette 70 holds a print tape 71 and an ink ribbon 72 in a cassette case 73. The ink ribbon cassette 85 holds an ink ribbon 87 in a cassette case 88. Plural types of tape cassettes respectively holding print tapes 71 of different widths are prepared for the tape cassette 70.

Figure 6:
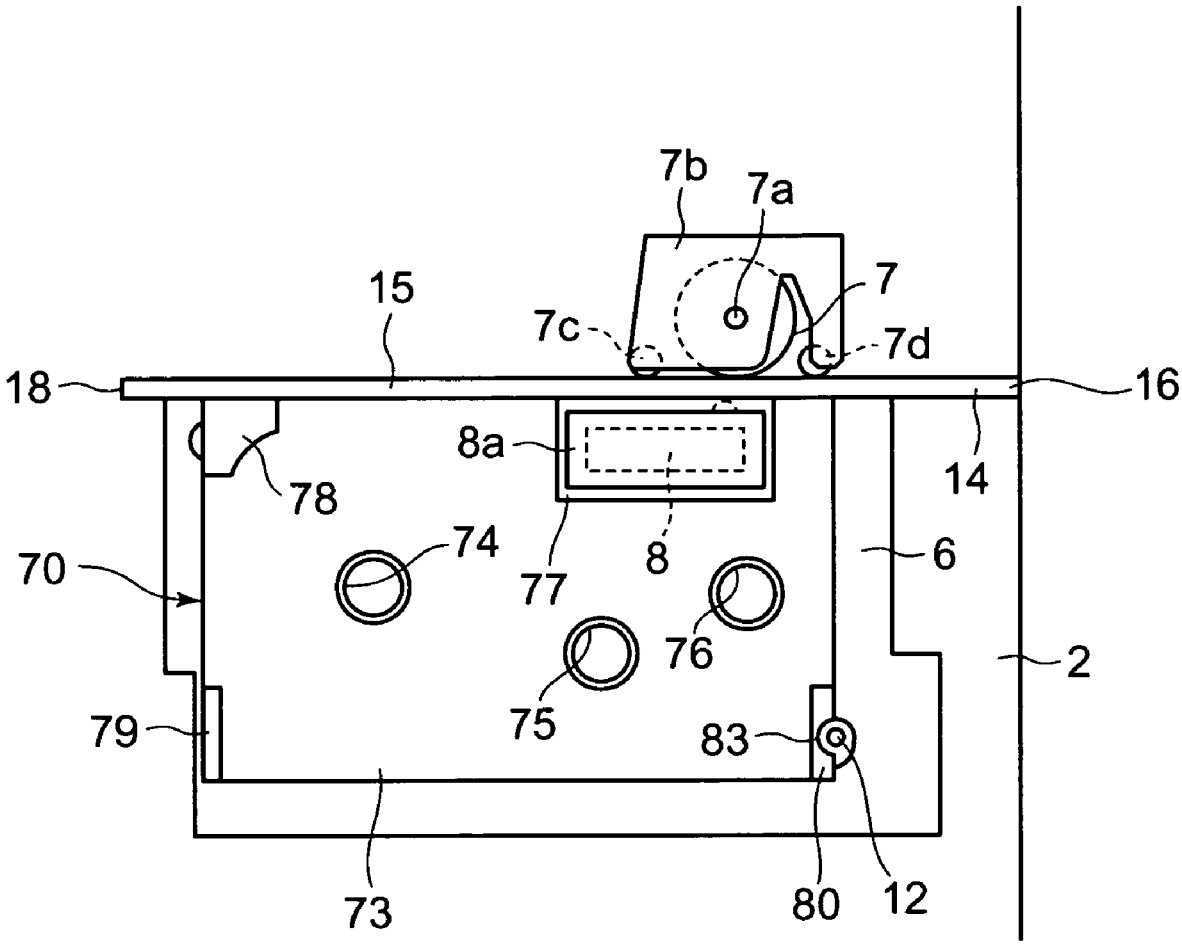
FIG. 6 is a plan view showing a tape cassette received in the receiving section of the printing apparatus.
Figure 7:
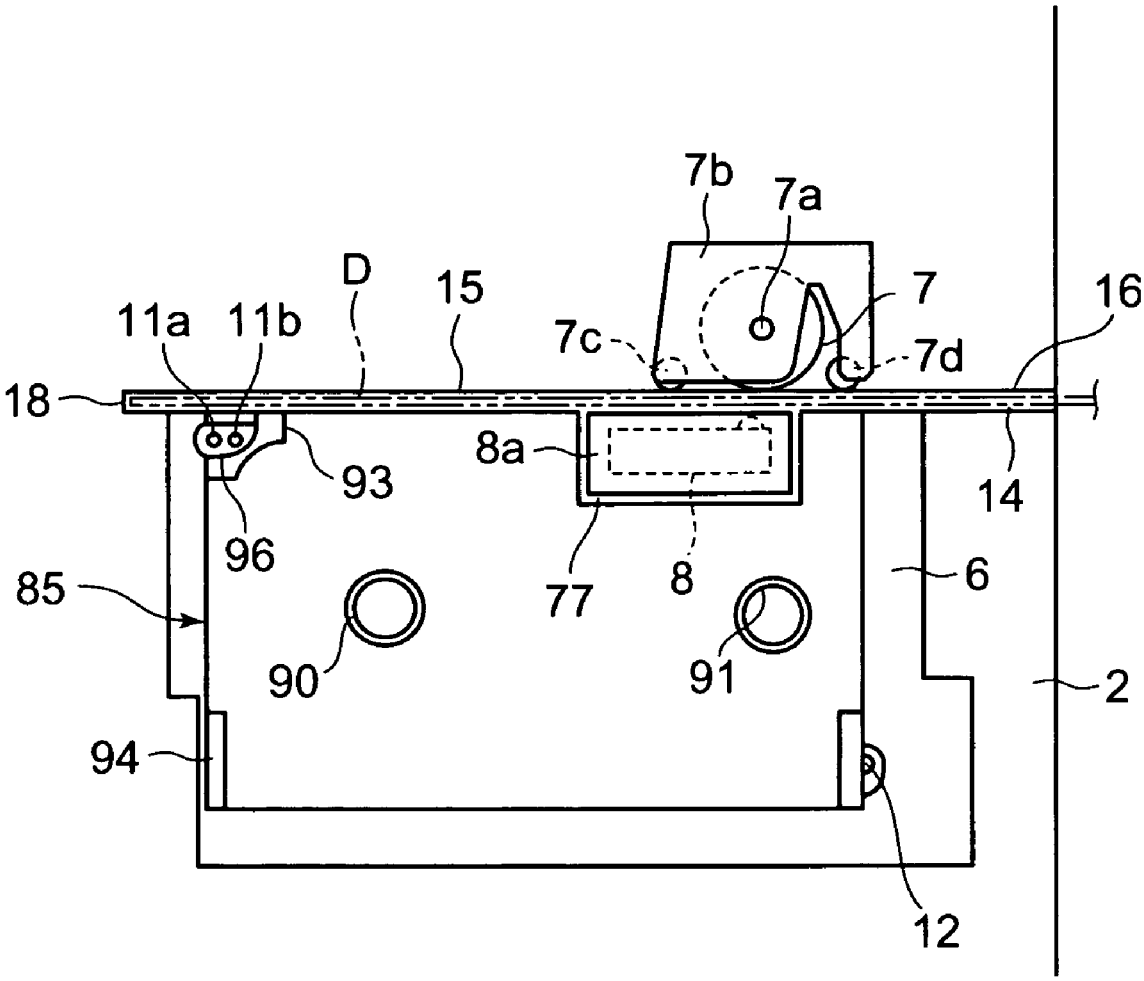
FIG. 7 is a plan view showing an ink ribbon cassette received in the receiving section of the printing apparatus.

In printing on the print tape, the tape cassette 70 is received in the receiving section 6 as shown in FIG. 6. In printing on the label side of a disk-like recording medium, the ink ribbon cassette 85 and an optical disk D are received in the receiving section 6 as shown in FIG. 7. To retain the optical disk D in the receiving section 6, the optical disk D is set upright, with a label side A to be a print side facing the front side of the main body 1, and a data recording side B opposite to the label side A facing the rear side of the main body 1, as shown by a chain line in FIG. 8, and the upright optical disk D is inserted in a direction indicated by an arrow C from outside the main body 1, and is placed at a position in the main body 1 indicated by a solid line in FIG. 8. A detailed description will be given later on how to receive an optical disk D in the main body 1.

As shown in FIGS. 2 and 3, the receiving section 6 is provided with a platen roller 7, a print head (thermal head) 8 and a ribbon take-up shaft 9. The platen roller 7 is rotatably attached to a mount frame 7*b* with its rotary shaft 7*a* facing perpendicularly, and is rotated by an unillustrated printing motor.

When the tape cassette 70 is received in the receiving section 6, the platen roller 7 conveys the print tape 71 and the ink ribbon 72, held in the tape cassette 70, while sandwiching the print tape 71 and the ink ribbon 72 with the thermal head 8. When the ink ribbon cassette 85 and the optical disk D are received in the receiving section 6, the platen roller 7 conveys an ink ribbon 87 and the optical disk D while sandwiching the ink ribbon 87 and the optical disk D with the thermal head 8.

Auxiliary rollers 7*c* and 7*d*, located near both respective sides of the platen roller 7 to feed the optical disk D along a predetermined feed passage, are rotatably provided on the mount frame 7*b*. At the time the optical disk D is fed, the three rollers, the platen roller 7 and the auxiliary rollers 7*c* and 7*d*, abut on the optical disk D to linearly feed the optical disk D along the predetermined feed passage. The upstream auxiliary roller 7*c* may be omitted, leaving the downstream auxiliary roller 7*d* alone, so that the optical disk D is supported by the two rollers, the platen roller 7 and the auxiliary roller 7*d*.

The thermal head 8 is provided rotatable in a head cover 8*a*, and is laid out facing the platen roller 7. The thermal head 8 thermally transfers the ink of the ink ribbon 72 on the print tape 71 when the tape cassette 70 is received in the receiving section 6, and thermally transfers the ink of the ink ribbon 87 on the optical disk D when the ink ribbon cassette 85 is received in the receiving section 6.

The thermal head 8 has a row of heat generating elements laid out perpendicular to the widthwise direction to the print tape 71 and the ink ribbon 72, 87. The heat generating elements are selectively driven and heated based on print data. The ribbon take-up shaft takes up the ink ribbon 72 of the tape cassette 70, and the ink ribbon 87 of the ink ribbon cassette 85, both used in printing, in the respective cassette cases 73 and 88.

The receiving section 6 is provided with a plurality of supports 10*a*, 10*b* and 10*c* and an engagement portion 10*e*, which engage with the tape cassette 70 and the ink ribbon cassette 85 to support them at a predetermined position. The receiving section 6 is provided with a plurality of tape cassette detection switches 11*a* and 11*b* for discriminating whether or not the tape cassette 70 is received in the receiving section 6 and discriminating the widthwise size of the tape. The receiving section 6 is also provided with an ink ribbon cassette detection switch 12 for detecting if the ink ribbon cassette 85 is in the receiving section 6. The receiving section 6 is further provided with a disk detection sensor 13 which indicates that the optical disk D is received at a predetermined position and the print start position for the optical disk D.

Figure 10A:
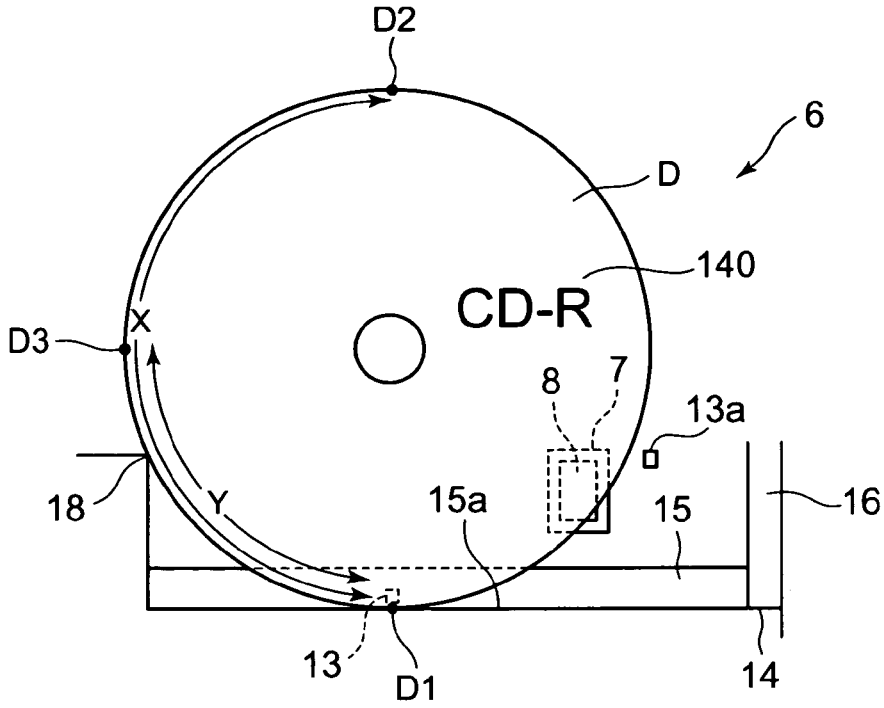
FIG. 10A is an explanatory diagram illustrating an optical disk received at the initial reception position in the receiving section of the printing apparatus.
Figure 10B:
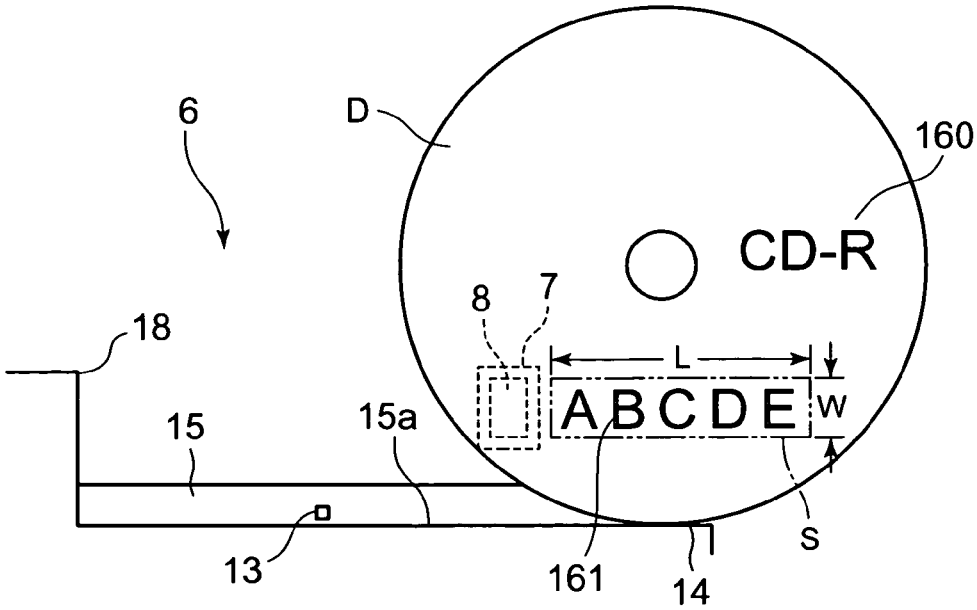
FIG. 10B is an explanatory diagram illustrating a state where printing on an optical disk is finished by the printing apparatus.

A guide section 15 is provided at the inner bottom portion of the receiving section 6. The guide section 15 guides the optical disk D, which is received upright in the receiving section 6 and is fed with its lower end abutting on the guide section 15 while being held between the platen roller 7 and the thermal head 8. As shown in FIGS. 10A and 10B, the guide section 15 is formed into a groove-like shape having a flat guide surface 15*a* at the bottom of the receiving section 6, and extends linearly horizontally from inside the main body 1 so as to communicate with the outside. The optical disk D, which is fed horizontally while being held between the platen roller 7 and the thermal head 8, is guided along the guide section 15 with its lower end abutting on the guide surface 15*a*.

The guide section 15 defines the feed passage for the optical disk D. The interior of the main body 1 is at the upstream of the feed passage, and the exterior of the main body 1 is at the downstream. The platen roller 7 and the thermal head 8 are arranged at a predetermined position in the lengthwise direction of the guide section 15 in such a way as to face each other with the guide section 15 in between. The position is a print position where printing is done on the print tape 71 or the optical disk D. A part of the guide section 15, which is on the downstream side of the feed passage for the optical disk D to near the print position, also serves as a feed passage for the print tape 71.

The end portion of the guide section 15 which faces outside the main body 1 is an opening 16 open to the side portion of the body case 2 of the main body 1. The opening 16 serves as a discharge port to discharge the print tape 71, subjected to printing in the main body 1, outside the main body 1. The opening 16 also serves as an insertion portion to insert the optical disk D into the main body 1, as will be described later.

As shown in FIG. 3, a cutting mechanism 17 for cutting the printed portion of the printed print tape 71 at the distal end is provided at the body case 2 of the main body 1 in the vicinity of the opening 16. The cutting mechanism 17 has a fixed blade 17*a* and a movable blade 17*b*, which are provided so as to face each other with the feed passage for the print tape 71 in between. The fixed blade 17*a* is fixed inside the body case 2, and the movable blade 17*b* is provided movable in the direction away from the fixed blade 17*a*.

When printing on the print tape 71 held in the tape cassette 70 is done, the movable blade 17*b* is driven by a cutter motor to move toward the fixed blade 17*a*. The movement causes the print tape 71 to be held between the fixed blade 17*a* and the movable blade 17*b* and cut. After cutting, the movable blade 17*b* moves away from the fixed blade 17*a* and stops at a standby position.

Provided at the upstream end of the guide section 15 provided in the main body 1 is a positioning portion 18 which abuts on the insertion-side peripheral portion of the optical disk D inserted through the opening 16 at the downstream end and received in the main body 1 to position the optical disk D at the initial reception position, as shown in FIG. 10A.

The disk detection sensor 13 which detects that the optical disk D is received in the receiving section 6 at the initial reception position is a transparent optical sensor having a light emitting portion and a light receiving portion. The light emitting portion and the light receiving portion are provided facing each other in the groove of the guide section 15. As shown in FIG. 10A, the disk detection sensor 13 is located at such a position at which the lowermost end of the optical disk D comes close when the optical disk D is placed upright at the predetermined initial reception position in the receiving section 6.

As shown in FIG. 10A, given that with the optical disk D placed upright at the predetermined initial reception position in the receiving section 6, D1 is the position of the peripheral edge of the optical disk D vertically directly underlying the center of the optical disk D, D2 is likewise the vertically directly overhead position, and D3 is the horizontal downstream end portion of the peripheral edge of the optical disk D through the center of the optical disk D, the layout position of the disk detection sensor 13 may be any position in the printing apparatus P which corresponds to the lower-half peripheral edge of the optical disk D from the position D1 (vicinity inclusive) to the position D2 (vicinity inclusive) and the position D2 (the range indicated by the letter "X" in FIG. 10A). The printing apparatus P is so constructed as to receive the lower half of the upright optical disk D in the receiving section 6 with the disk's upper half exposed to outside the main body 1. It is therefore preferable that the layout position of the disk detection sensor 13 substantially correspond to the peripheral edge of the optical disk D from the position D1 to the position D3 (the range indicated by the letter "Y" in FIG. 10A) shown in FIG. 10A.

As the disk detection sensor 13 is located near the peripheral edge of the optical disk D at the downstream side in the feed direction including the position directly underlying the center of the optical disk D at the initial reception position, it is possible to surely detect the presence of the optical disk D placed at the initial reception position. At the predetermined layout position of the disk detection sensor 13, the transition from the presence of the optical disk D to the absence thereof can be accurately detected when the optical disk D is fed downstream at the time of printing. When feeding the optical disk D starts upon initiation of printing, therefore, the disk detection sensor 13 can detect the movement of the optical disk D so that printing by the thermal head 8 can be started based on the detected information. In this manner, the disk detection sensor 13 can acquire information on the presence or absence of the optical disk D at the initial reception position and information on the positioning of the optical disk D at the print start position.

The receiving-section cover 5 provided on the receiving section 6 is rotatably supported on the top surface of the body case 2 by a hinge. The receiving-section cover 5 is provided with transparent windows 20 and 21 at positions corresponding to the positions of the display section 4 and the receiving section 6. Cassette pressers 22*a*, 22*b* and 22*c* are provided at the bottom of the receiving-section cover 5. The cassette pressers 22*a*, 22*b* and 22*c* abut on the top surfaces of the tape cassette 70 and the ink ribbon cassette 85 received in the in the receiving section 6 and restrict the vertical positions of the cassettes.

A slit-like ejection port (disk ejection port) 23 extending linearly to one side (right side) of the body case 2 (main body 1) from the center portion of the receiving-section cover 5 is formed in the receiving-section cover 5. With the receiving-section cover 5 closed, the ejection port 23 faces the receiving-section cover 5 vertically, and one side of the ejection port 23 on one side of main body 1 communicates with the opening 16, and both the ejection port 23 and the opening 16 are open to outside at the side portion of the main body 1.

When the upright optical disk D is inserted through the opening 16 and is moved horizontally, the optical disk D moves upstream in the feed direction along the receiving-section cover 5 and the ejection port 23 and reaches the initial reception position in the receiving section 6. At this time, nearly the upper half of the optical disk D protrudes outside the printing apparatus P from the ejection port 23.

At the time of printing, the optical disk D is fed downstream along the receiving-section cover 5 and the ejection port 23 during which printing on the optical disk D is done. After printing, the optical disk D is placed at an ejection portion 14 at the downstream end portion of the receiving-section cover 5, as shown in FIG. 10B, so that the optical disk D placed at the ejection portion 14 can be pulled up through the ejection port 23 out of the main body 1. The area indicated by the letter "S" in FIG. 10B is a print area at a part of the lower half portion of the optical disk D on which printing is done in the printing operation. The print area S has a width (height) W and a length L. The width W corresponds to the size of the row of heat generating elements of the thermal head 8, and the length L to the relatively moving distance of the thermal head 8 to the optical disk D at the time of printing. A sequence of characters "CD-R" shown in FIGS. 10A and 10B by reference numeral "160" is pre-printed on the label side of the optical disk D, and a sequence of characters "ABCDE" shown in FIG. 10B by reference numeral "161" is what is printed by the printing apparatus P.

Printing is done as the optical disk D is fed downstream from the upstream side along the guide section 15. When printing ends, the optical disk D is fed to the position of the ejection portion 14 and stops with its downstream-side portion in the feed direction sticking out the main body 1. The optical disk D has the weight balanced at the right and left to the vertical center line. A half or greater portion of the optical disk D at the upstream side in the feed direction, which has been fed to the ejection portion 14 and is stopped there at the end of printing, is supported on the ejection portion 14. That is, the optical disk D is supported on the ejection portion 14 while the barycenter of the optical disk D, which is at the center in the feed direction and at the center of the optical disk D, directly overlies the ejection portion 14 or is positioned little inward of the main body 1 from the directly overlying position. This facilitates ejection of the optical disk D out of the apparatus after printing, and prevents the weight of the optical disk D from being off balanced and from falling out from the ejection portion 14. Particularly, the optical disk D has a circular shape, and, what is more, printing is done with the optical disk D upright. Therefore, the optical disk D after printing may fall out of the apparatus and roll upright unless the optical disk D is carefully handled. However, the feeding of the optical disk D after printing in the aforementioned manner can reliably avoid such an inconvenience and surely hold the optical disk D on the main body 1.

Figure 11:
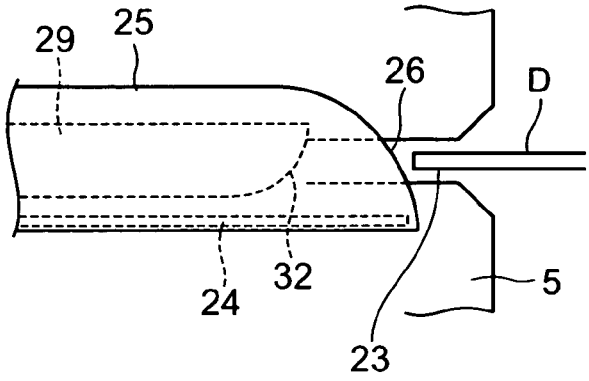
FIG. 11 is an explanatory diagram showing an ejection-port cover and an insertion-prevention member of the printing apparatus as seen from the plan view.
Figure 12:
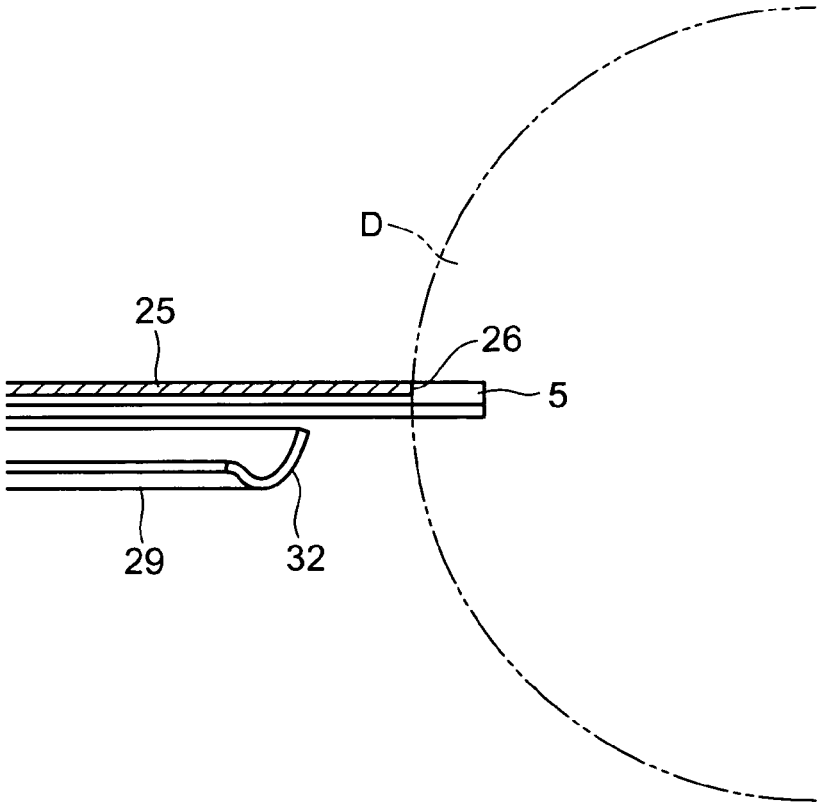
FIG. 12 is an explanatory diagram showing the ejection-port cover and the insertion-prevention member of the printing apparatus as seen from the side.

An elongated plate-like ejection cover 25 extending in the lengthwise direction of the ejection port 23 is provided on the receiving-section cover 5 to prevent dust from entering the ejection port 23. As shown in FIGS. 11 and 12, one side edge of the ejection cover 25 on the key input section 3 side along the lengthwise direction of the ejection port 23 (fore and front side of the main body 1) is rotatably attached to the receiving-section cover 5 via a shaft 24, and the ejection cover 25 is normally folded down by the dead weight, covering the ejection port 23. Although not illustrated, a magnet is provided at one portion of the free end side of the ejection cover 25 at the back side thereof, and a metal piece is provided at the corresponding position of the edge portion of the ejection port 23 of the receiving-section cover 5, so that the magnetic force of the magnet prevents the ejection cover 25 from being opened unintentionally.

Figure 8:
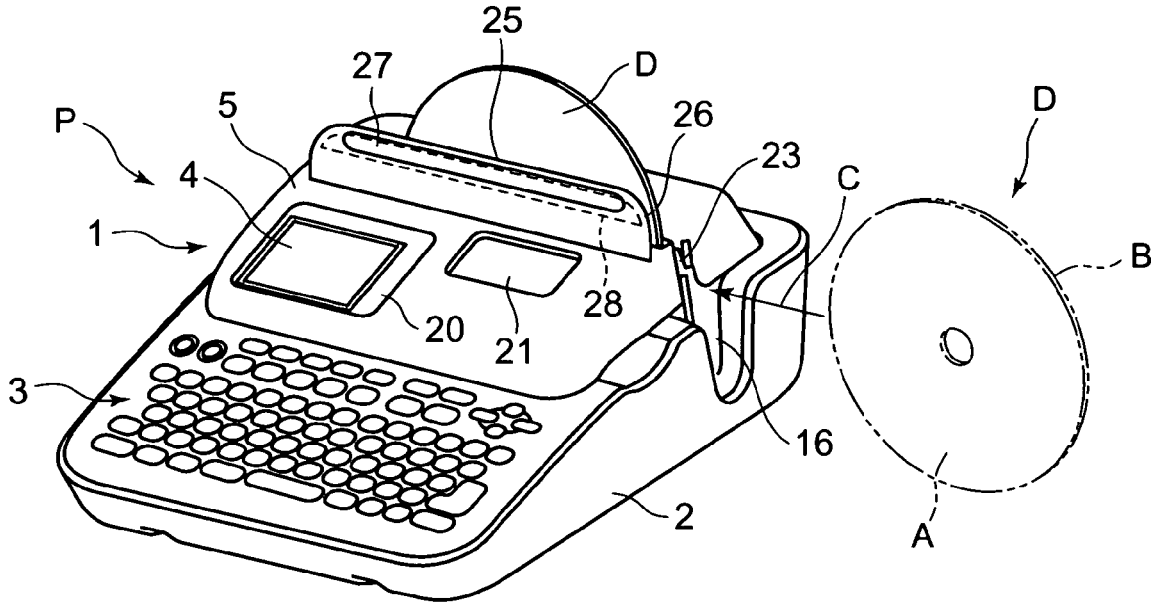
FIG. 8 is a perspective view showing an optical disk received in the receiving section of the printing apparatus.
Figure 9A:
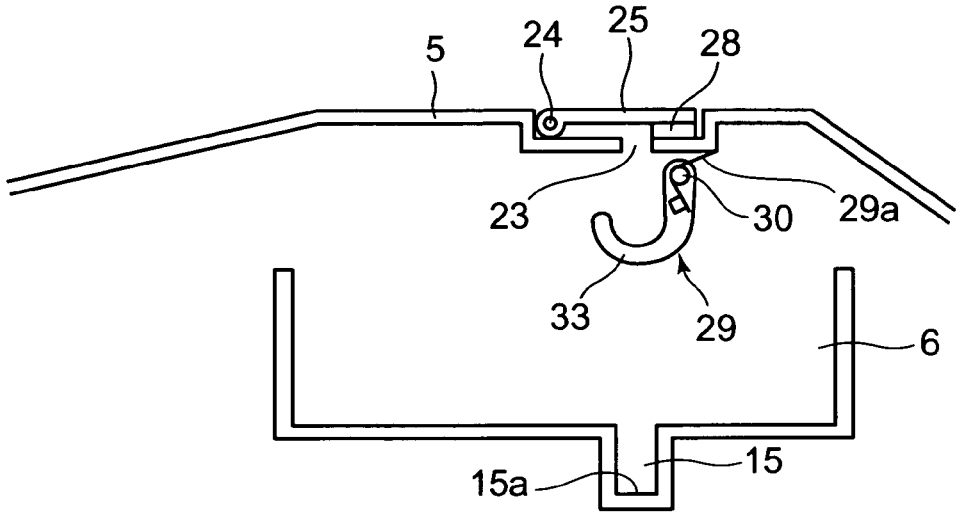
FIG. 9A is a cross-sectional view of the receiving section of the printing apparatus.
Figure 9B:
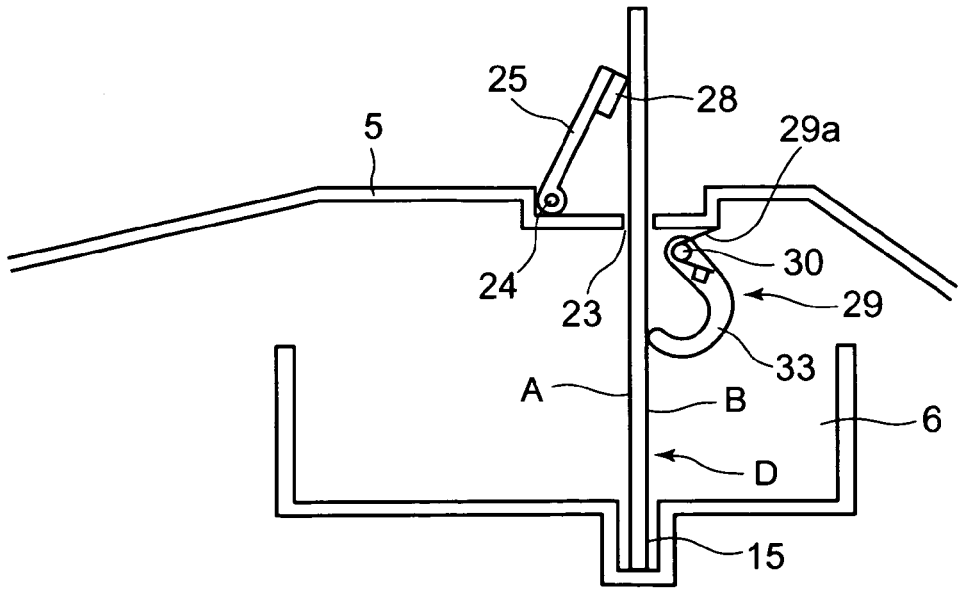
FIG. 9B is a cross-sectional view showing an optical disk received in the receiving section of the printing apparatus.

The end portion of the ejection cover 25 which faces the opening 16 serves as an inclined portion 26 inclined toward the free end side of the ejection cover 25 from the shaft 24 with respect to the direction orthogonal to the shaft 24 in a plan view, as shown in FIG. 11. As the optical disk D is inserted upright through the opening 16 along the guide section 15, as shown in FIG. 12, the outer edge of the upper half of the optical disk D on the insertion-end side (the leading side in the moving side at the time of insertion) abuts on the inclined portion 26 with the lower end portion of the optical disk D abutting on the guide surface 15*a* at the bottom of the guide section 15. When the optical disk D is inserted upright through the opening 16 along the guide section 15, therefore, the insertion-side end portion of the upper half of the optical disk D abuts on the inclined portion 26, as shown in FIG. 12. The abutment presses the ejection cover 25 against the optical disk D and turns the ejection cover 25 upward about the shaft 24, facing the key input section 3 on the front side of the printing apparatus P in such a way as to cover the label side A of the optical disk D and standing upright as shown in FIGS. 8 and 9B.

The ejection cover 25 is formed of a transparent material, so that the label side A of the optical disk D can be seen when the optical disk D placed upright with the label side A facing the fore and front side of the printing apparatus P is received in the main body 1 and the ejection cover 25 stands upright covering the label side A of the optical disk D at the fore side of the label side A. A bar-like positioning mark 27 colored by a predetermined color is provided at the ejection cover 25 of a transparent material in the lengthwise direction as shown in FIG. 8.

With the optical disk D received at the initial reception position in the receiving section 6, as the optical disk D is rolled at the initial reception position and its position is adjusted in such a way that the pre-printed portion, such as a maker name or a product name like "CD-R", pre-printed on the label side A of the optical disk D, becomes in parallel to the positioning mark 27. Accordingly, the direction of the sequence of characters to be printed by the printing apparatus P can be positioned in parallel to the pre-printed portion.

While the material for the ejection cover 25 is preferably a transparent material, it may be an opaque material. The positioning mark 27 is not limited to the illustrated bar-like shape as long as it can position the direction of the sequence of characters to be printed by the printing apparatus P in parallel to the pre-printed portion.

A buffer member 28 is provided at the back side of the ejection cover 25 in the lengthwise direction. As the optical disk D is inserted through the opening 16 with the label side A facing the fore and front side of the main body 1, the label side A of the optical disk D slides on the back side of the ejection cover 25. The buffer member 28 provided at the back side of the ejection cover 25 can however protect the label side A of the optical disk D.

The receiving-section cover 5 is provided with an insertion-prevention member 29 as an insertion-prevention section to prevent the optical disk D from being erroneously inserted in the receiving section 6 through the ejection port 23 from above. The insertion-prevention member 29 is provided rotatably at the receiving-section cover 5 below the ejection port 23 by a shaft 30 provided in parallel to the shaft 24. The insertion-prevention member 29 is elastically urged by a spring member 29*a* so as to rotate to face the ejection port 23, so that the insertion-prevention member 29 is normally so held as to face the ejection port 23 below the ejection port 23.

The insertion-prevention member 29 is provided in the lengthwise direction of the ejection port 23, and its end portion facing the opening 16 serves as an inclined surface 32 inclined from the shaft 30 side toward the opposite free end side in a plan view as shown in FIG. 11. As shown in FIG. 12, when the optical disk D is inserted upright along the guide section 15, the insertion-side lower-half outer edge of the optical disk D abuts on the inclined surface 32 while the lower end portion of the optical disk D abuts on the guide surface 15*a* at the bottom of the guide section 15.

When the optical disk D is inserted through the opening 16, as shown in FIG. 12, the insertion-side end of the lower half of the optical disk D abuts on the inclined surface 32 of the insertion-prevention member 29. Accordingly, the insertion-prevention member 29 rotates downward about the shaft 30, opening the underside of the ejection port 23. This can allow for the insertion of the optical disk D.

The insertion-prevention member 29 has a cross section nearly shaped like the shape of the English letter "J". The upper end portion of the insertion-prevention member 29 is rotatably supported on the receiving-section cover 5. A portion of the upper end portion extending downward from the upper end is a stop portion 32 curved in an arcuate shape. The stop portion 32 normally faces the ejection port 23 at a position in the main body 1 directly below the ejection port 23.

When the optical disk D is erroneously inserted through the ejection port 23 from above, the insertion-prevention member 29 is pressed by the optical disk D and is rolled slightly, but the optical disk D is stopped by the stop portion 32 and is inhibited from being further inserted into the main body 1.

In the printing apparatus P, the platen roller 7 and the thermal head 8 are provided upright in the receiving section 6 in such a way as to face the guide section 15. When the ink ribbon cassette 85 is received in the receiving section 6 and printing is to be done on the optical disk D, the ink ribbon 87 of the ink ribbon cassette 85 is fed horizontally downward from the upstream of the guide section 15 with the widthwise direction of the ink ribbon 87 facing vertically.

When the optical disk D is inserted upright in the receiving section 6 through the opening 16 along the guide section 15, the ink side of the ink ribbon 87 faces the label side (print side) A of the optical disk D, and the feed direction of the ink ribbon 87 (ribbon feed direction) becomes in parallel to the insertion direction of the optical disk D. Therefore, the ink ribbon 87 is unlikely to be caught by the optical disk D at the time the optical disk D is inserted in the main body 1. In other words, the optical disk D is inserted in the main body 1 in the direction parallel to the feed direction of the ink ribbon 87, so that disk insertion is carried out smoothly without twisting or damaging the ink ribbon 87.

If the optical disk D is inserted upright in the receiving section 6 through the ejection port 23, the ink side of the ink ribbon 87 faces the label side A of the optical disk D, and the feed direction of the ink ribbon 87 (ribbon feed direction) becomes orthogonal to the insertion direction of the optical disk D. With the ribbon feed direction orthogonal to the insertion direction of the optical disk D, the ink ribbon 87 may be caught and damaged by the optical disk D when the optical disk D is inserted in the main body 1. As a solution to the probable trouble, the insertion-prevention member 29 is provided in association with the ejection port 23 in the printing apparatus P, thus preventing the insertion of the optical disk D from the direction orthogonal to the feed direction (ribbon feed direction) of the ink ribbon through the ejection port 23.

The tape cassette 70 and the ink ribbon cassette 85 to be received in the receiving section 6 will be explained more specifically referring to FIGS. 4 and 5.

As shown in FIGS. 4A and 4B, the tape cassette 70 has the cassette case 73. The cassette case 73 accommodates a tape core 74 around which the print tape 71 is wound, a ribbon feed core 75 around which an unused ink ribbon 72 is wound, and a ribbon take-up core 76 which takes up the printed or used portion of the ink ribbon 72.

The cassette case 73 is provided with a head insertion portion 77 through which the thermal head 8 is inserted and which is formed by shaping a part of the outer wall of the cassette case 73 in a recess shape. The print tape 71 and the ink ribbon 72 are fed out from inside the cassette case 73 into the head insertion portion 77. The ink ribbon 72 used in printing is taken up around the ribbon take-up core 76, and is circulated inside the cassette case 73.

To-be-supported portions 78, 79 and 80 corresponding to the supports 10*a*, 10*b* and 10*c* of the receiving section 6 are provided at the corner portions of the cassette case 73. Cutaway portions 81 and 82, indicated by broken lines in FIG. 4A, are provided at the to-be-supported portion 78 in association with the tape cassette detection switches 11*a* and 11*b* and in accordance with the types of the cassettes to set the tape cassette detection switches 11*a* and 11*b* on and off. There are three cassette types: either one of the cutaway portions 81 and 82 provided and no cutaway portion provided. The to-be-supported portion 80 is provided with a cutaway portion 83 in association with the ink ribbon cassette detection switch 12.

As shown in FIGS. 5A and 5B, the ink ribbon cassette 85 has the cassette case 88. The cassette case 88 accommodates a ribbon feed core 90 around which an unused ink ribbon 87 is wound, and a ribbon take-up core 91 which takes up the printed or used portion of the ink ribbon 87.

The cassette case 88 is provided with a head insertion portion 92 through which the thermal head 8 is inserted and which is formed by shaping a part of the outer wall of the cassette case 88 in a recess shape. The ink ribbon 87 is fed out from inside the cassette case 88 into the head insertion portion 92. The ink ribbon 87 used in printing is taken up around the ribbon take-up core 91, and is circulated inside the cassette case 88.

To-be-supported portions 93, 94 and 95 corresponding to the supports 10*a*, 10*b* and 10*c* are provided at the cassette case 88. A cutaway portion 96 is provided at the to-be-supported portion 93 in association with the tape cassette detection switches 11*a* and 11*b* to set the switches off. No cutaway portion is provided at the to-be-supported portion 95 corresponding to the ink ribbon cassette detection switch 12, thereby allowing the switch 12 to be set on.

When the tape cassette 70 is mounted into receiving section 6 of the printing apparatus P with the above-described structure, the thermal head 8 is placed into the head insertion portion 77 of the cassette case 73, and the ribbon take-up shaft 9 is fitted into the ribbon take-up core 76. When the ink ribbon cassette 85 is mounted into receiving section 6 of the printing apparatus P with the above-described structure, the thermal head 8 is placed into the head insertion portion 92 of the cassette case 88, and the ribbon take-up shaft 9 is fitted into the ribbon take-up core 91.

Next, the printing/feeding mechanism which constitutes the printing section and the feeder will be described referring to FIGS. 13 to 17. The printing/feeding mechanism is provided in the main body 1, and performs various operations, such as movement of the thermal head 8 between the print position and the non-print position, feeding of the print tape 71, the ink ribbons 72 and 87, and the optical disk D, take-up of the ink ribbons 72 and 87, and tensioning of the ink ribbons 72 and 87.

A single printing motor 35 serves as a drive source. Reference numeral "36" denotes an output gear 36 for the printing motor 35. Reference numerals "37" to "40" denote first to fourth reduction gears, Reference numeral "41" denotes a first sun gear, Reference numeral "42" denotes a first planet gear, and Reference numeral "43" denotes a second planet gear. Reference numeral "45" denotes a cam gear having a cam groove 46 and first and second tooth-less portions 47 and 48. The first and second tooth-less portions 47 and 48 do not have teeth at different thicknesswise positions of the peripheral portion thereof.

Figure 18:
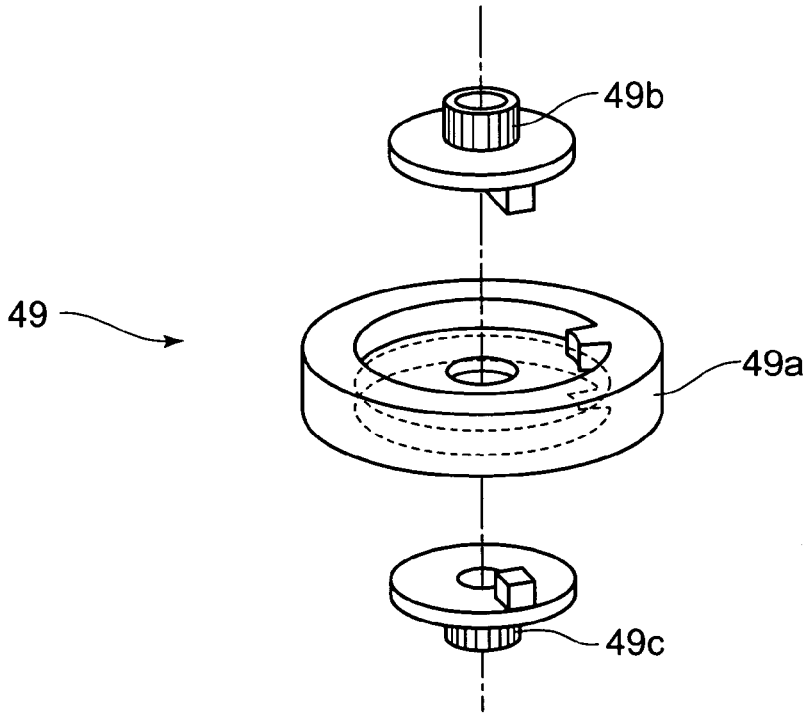
FIG. 18 is a diagram showing the structure of a lag gear mechanism of the printing/feeding mechanism.

A lag gear mechanism 49 has three lag gears 49*a*, 49*b* and 49*c* as shown in FIG. 18, and has a lag function between the gears 49*a* and 49*b* and between the gears 49*a* and 49*c*.

A one-way gear 50 transmits drive power only in one rotational direction. Platen gears 51 and 52 are provided coaxially with the platen roller 7. Reference numeral "53" denotes a second sun gear, Reference numeral "54" denotes a third planet gear, Reference numeral "55" denotes an intermediate gear, Reference numeral "56" denotes a third sun gear, Reference numeral "57" denotes a fourth planet gear, and Reference numeral "58" denotes a ribbon take-up gear 58 provided coaxially with the ribbon take-up shaft 9.

The output gear 36 of the motor 35 engages with the first sun gear 41 via the first to fourth reduction gears 37 to 40. the first planet gear 42 and the second planet gear 43 are laid out around the first sun gear 41, and engage with the first sun gear 41. The first planet gear 42 is positioned at the same level as the first tooth-less portion 47 of the cam gear 45, and the second planet gear 43 is positioned at the same level as the second tooth-less portion 48. The first planet gear 42 and the second planet gear 43 are supported on the first sun gear 41 in such a way as to be engageable with the cam gear 45.

The first sun gear 41 engages with the lag gear 49*a* of the lag gear mechanism 49. One of the lag gears 49*b* and 49*c* which rotate with a delay with respect to the rotation of the lag gear 49*a* engages with the one-way gear 50, and the other one engages with the intermediate gear 55.

The platen gear 51 coaxial with the platen roller 7 engages with the one-way gear 50, and the other platen gear 52 engages with the second sun gear 53. The intermediate gear 55 engages with the third sun gear 56.

The third planet gear 54, which engages with the second sun gear 53, is arranged around the second sun gear 53 in a revolvable manner, ÿ and the fourth planet gear 57, which engages with the third sun gear 56, is arranged around the third sun gear 56 in a revolvable manner. The third planet gear 54 and the fourth planet gear 57 engage with the ribbon take-up gear 58 according to the revolution.

A head arm 59 holds the thermal head 8. The head arm 59 has a pin 60 on the opposite side to the side where the thermal head 8 is mounted. The pin 60 engages with the cam groove 46 of the cam gear 45. The head arm 59 is elastically urged by a tension spring 61 and is rotatable about a shaft 62. The pin 60 slides toward the edge portion of the cam groove 46 in accordance with the rotation of the cam gear 45, causing the head arm 59 to rotate about the shaft 62.

Figure 13:
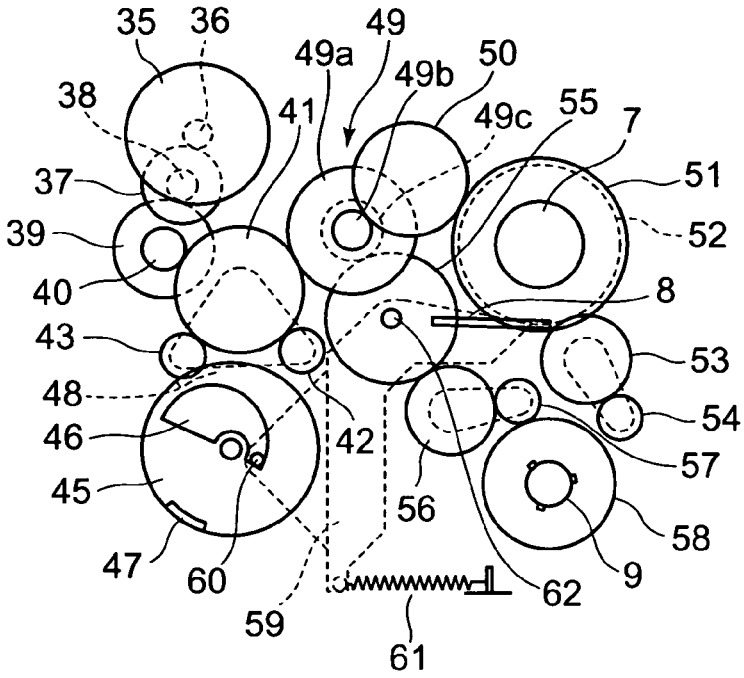
FIG. 13 is a diagram showing the structure of a printing/feeding mechanism of the printing apparatus.

FIG. 13 shows the initial state before printing starts. In this state, as illustrated in the diagram, the thermal head 8 is separated from the platen roller 7.

Figure 14:
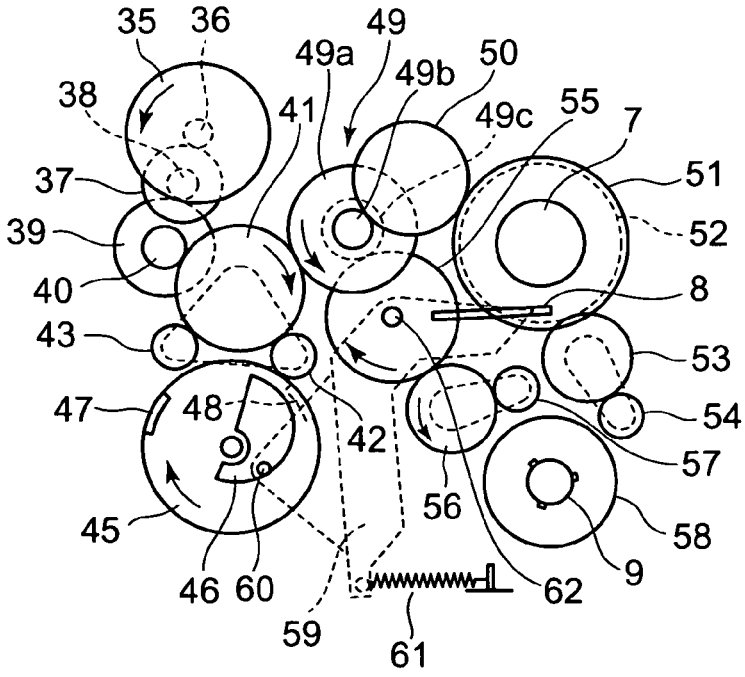
FIG. 14 is a diagram illustrating a state where the first stage of the printing/feeding mechanism is in operation.

FIG. 14 shows a state immediately after the printing motor 35 has started operating in response to a print start instruction. As the printing motor 35 rotates in the forward rotational direction indicated by the arrow in the diagram, the drive power is transmitted to the cam gear 45 via the gears 36 to 40, the first sun gear 41 and the first planet gear 42, rotating the cam gear 45 clockwise. As a result, the pin 60 moves long the edge portion of the cam groove 46, and the elastic force of the tension spring 61 causes the head arm 59 to rotate counterclockwise about the shaft 62, moving the thermal head 8 toward the platen roller 7.

The drive power of the printing motor 35 is transmitted to the lag gear 49*a* via the gears 36 to 40, and the first sun gear 41. Because of the lag function between the lag gear mechanism 49 and the lag gear 49*b*, however, the lag gear 49*b* does not rotate. Because the lag gear 49*b*, which is in engagement with the platen gear 51 via the one-way gear 50, does not rotate, the drive power is not transmitted to the platen roller 7.

At this time, no lag function works between the lag gear 49*a* and the lag gear 49*c*, so that the drive power of the first sun gear 41 is transmitted to the third sun gear 56 via the intermediate gear 55. Because the fourth planet gear 57 is disengaged from the ribbon take-up gear 58, however, the ribbon take-up shaft 9 is not driven. While the thermal head 8 is moving to the print position, therefore, neither the platen roller 7 nor the ribbon take-up shaft 9 is driven.

Figure 15:
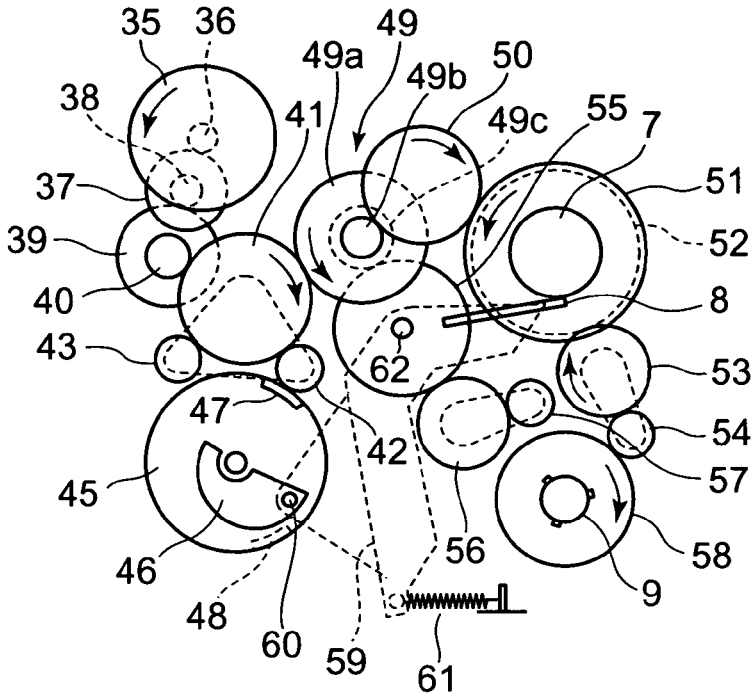
FIG. 15 is a diagram illustrating a state where the second stage of the printing/feeding mechanism is in operation.

FIG. 15 shows a state (head-down state) where the pressure of the thermal head 8 on the platen roller 7 is completed and the thermal head 8 is moved to the print position. Printing starts in this state. At this time, as illustrated in the diagram, the rotation of the cam gear 45 causes the first planet gear 42 to drop in the first tooth-less portion 47 of the cam gear 45. This disconnects the transmission of the drive power of the printing motor 35 to the cam gear 45, stopping the rotation of the cam gear 45, so that the thermal head 8 is held pressed against the platen roller 7.

At this time, the period of lagging between the lag gear 49*a* and the lag gear 49*b* ends, and the drive power of the printing motor 35 is transmitted to the platen gear 51 via the one-way gear 50, so that the platen roller 7 is driven. Further, the second sun gear 53 and the third planet gear 54 are driven via the platen gear 52, the third planet gear 54 engages with the ribbon take-up gear 58, permitting the transmission of the drive power, rotating the ribbon take-up shaft 9.

Figure 16:
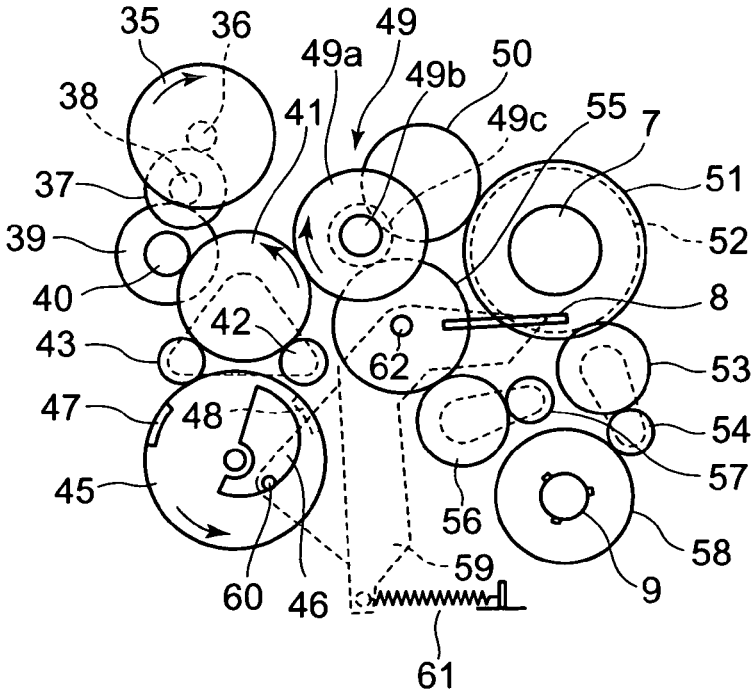
FIG. 16 is a diagram illustrating a state where the third stage of the printing/feeding mechanism is in operation.

FIG. 16 shows a state (head-up state) where printing is done, and the thermal head 8 is separated from the platen roller 7 and is moved to the non-print position. When printing is done, the printing motor 35 is driven reversely. As a result, the first sun gear 41 rotates counterclockwise, so that the first planet gear 42 disengages from the first tooth-less portion 47, and the second planet gear 43 engages with the cam gear 45. The engagement causes the drive power of the printing motor 35 to be transmitted to the cam gear 45, causing the cam gear 45 to rotate counterclockwise from the state in FIG. 15. The rotation of the cam gear 45 causes the head arm 59 to rotate clockwise, separating the thermal head 8 from the platen roller 7.

The one-way gear 50 rotates clockwise when the printing motor 35 rotates in the forward direction to transmit the drive power of the printing motor 35 to the platen gear 51. When the printing motor 35 rotates in the reverse direction, however, the one-way gear 50 blocks the transmission of the drive power so that the platen roller 7 does not rotate.

At this time, the lag gear 49*a* of the lag gear mechanism 49 rotates in response to the rotation of the first sun gear 41, but the lag function between the lag gear 49*a* and the lag gear 49*c* prevents the intermediate gear 55 and the third sun gear 56 from rotating. This disengages the fourth planet gear 57 from the ribbon take-up gear 58, inhibiting the transmission of the drive power to the ribbon take-up shaft 9.

Figure 17:
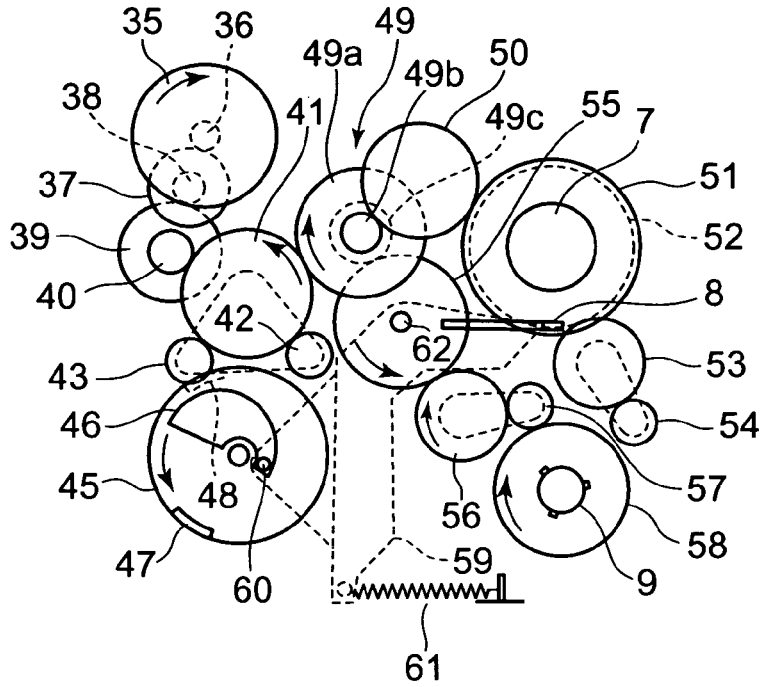
FIG. 17 is a diagram illustrating a state where the fourth stage of the printing/feeding mechanism is in operation.

FIG. 17 illustrates a process of tensioning the ink ribbon which is executed after the head-up state where the thermal head 8 is separated from the platen roller 7.

After the thermal head 8 is separated from the platen roller 7, the cam gear 45 further rotates counterclockwise, causing the second planet gear 43 to drop in the second tooth-less portion 48 of the cam gear 45. This stops the rotation of the cam gear 45, so that the thermal head 8 is kept positioned at the non-print position.

At this time, the lag function between the lag gear 49*a* and the lag gear 49*c* is released, causing the drive power to be transmitted to the intermediate gear 55 and the third sun gear 56 from the lag gear 49*a*. As a result, the fourth planet gear 57 engages with the ribbon take-up gear 58, causing the ribbon take-up shaft 9 to be rotated in the take-up direction. Accordingly, the ink ribbon loosened by the separation of the thermal head 8 from the platen roller 7 is taken up, and is tensioned. The tensioning of the ink ribbon is carried out by driving the printing motor 35 reversely only for a predetermined time set according to the head-up operation at the end of printing.

Printing is executed as the single printing motor 35 is driven in this manner and the operations in FIGS. 13 to 17 are repeated.

Figure 19A:
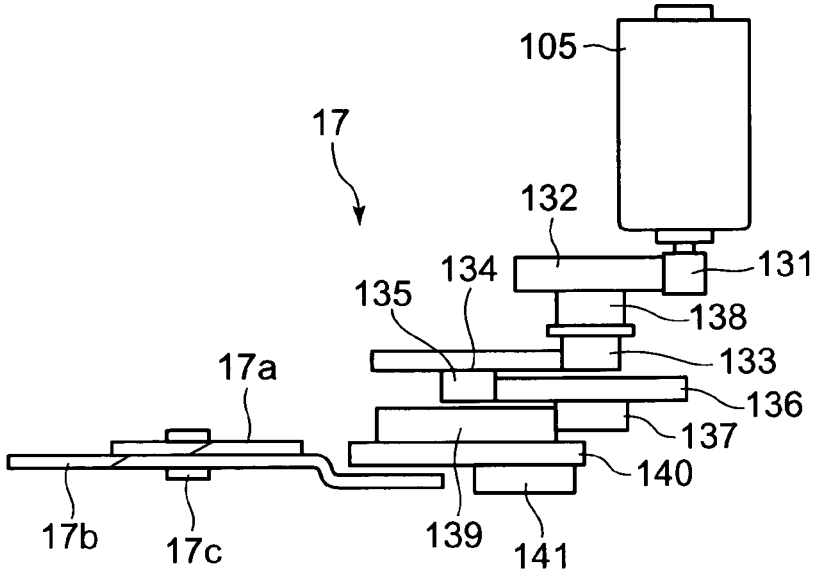
FIG. 19A is a plan view of a cutting mechanism.
Figure 19B:
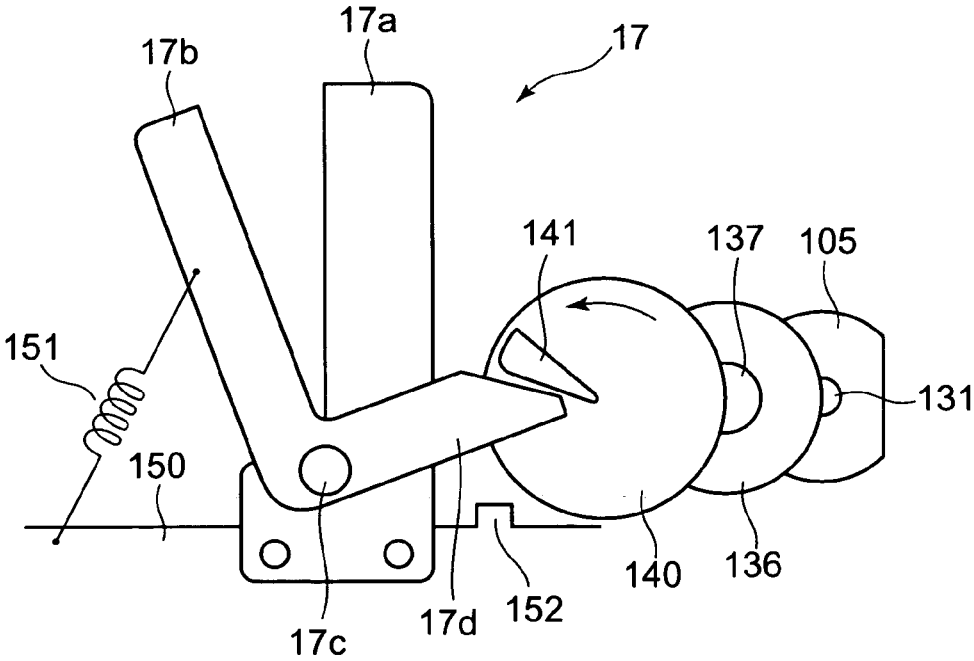
FIG. 19B is a side view of the cutting mechanism.

The structure of the cutting mechanism 17 will be described more specifically referring to FIGS. 19A and 19B. FIG. 19A is a plan view of the cutting mechanism 17, and FIG. 19B is a side view of the cutting mechanism 17. As shown in FIGS. 19A and 19B, the cutting mechanism 17 has the fixed blade 17*a*, fixed to a frame 150 provided in the main body 1, and the movable blade 17*b*. The movable blade 17*b* is rotatably supported on the fixed blade 17*a* by a shaft 17*c*, and is urged by a tension spring 151 in a direction of being open to the fixed blade 17*a*. The cutting mechanism 17 operates on the drive power of a cutter motor 105. An output gear 131 is provided on the output shaft of the cutter motor 105. The drive power of the cutter motor 105 is transmitted to a cam gear 139 via first to sixth reduction gears 132 to 137, rotating a cam plate 140 having a projection 141 provided integral with the cam gear 139. As the projection 141 of the cam plate 140 presses the end portion of an arm portion 17*d* connected to the lower end portion of the movable blade 17*b*, the movable blade 17*b* rotates toward the fixed blade 17*a* Reference numeral "138" denotes a clutch provided in the train of the reduction gears.

When the motor 105 rotates in the forward direction, for example, the cam plate 140 rotates counterclockwise, and the movable blade 17*b* rotates toward the fixed blade 17*a* to carry out the cutting operation. When the movable blade 17*b* moves to the position at which the movable blade 17*b* crosses the fixed blade 17*a*, the arm portion 17*d* of the movable blade 17*b* abuts on a stopper portion 152 provided on the frame 150, inhibiting further rotation of the movable blade 17*b*, and the clutch 138 works to absorb the drive power of the cutter motor 105. When the cutter motor 105 is rotated reversely after the cutting operation finishes, the cam plate 140 rotates clockwise, and the movable blade 17*b* moves to the initial position by the action of the tension spring 151.

Figure 20:
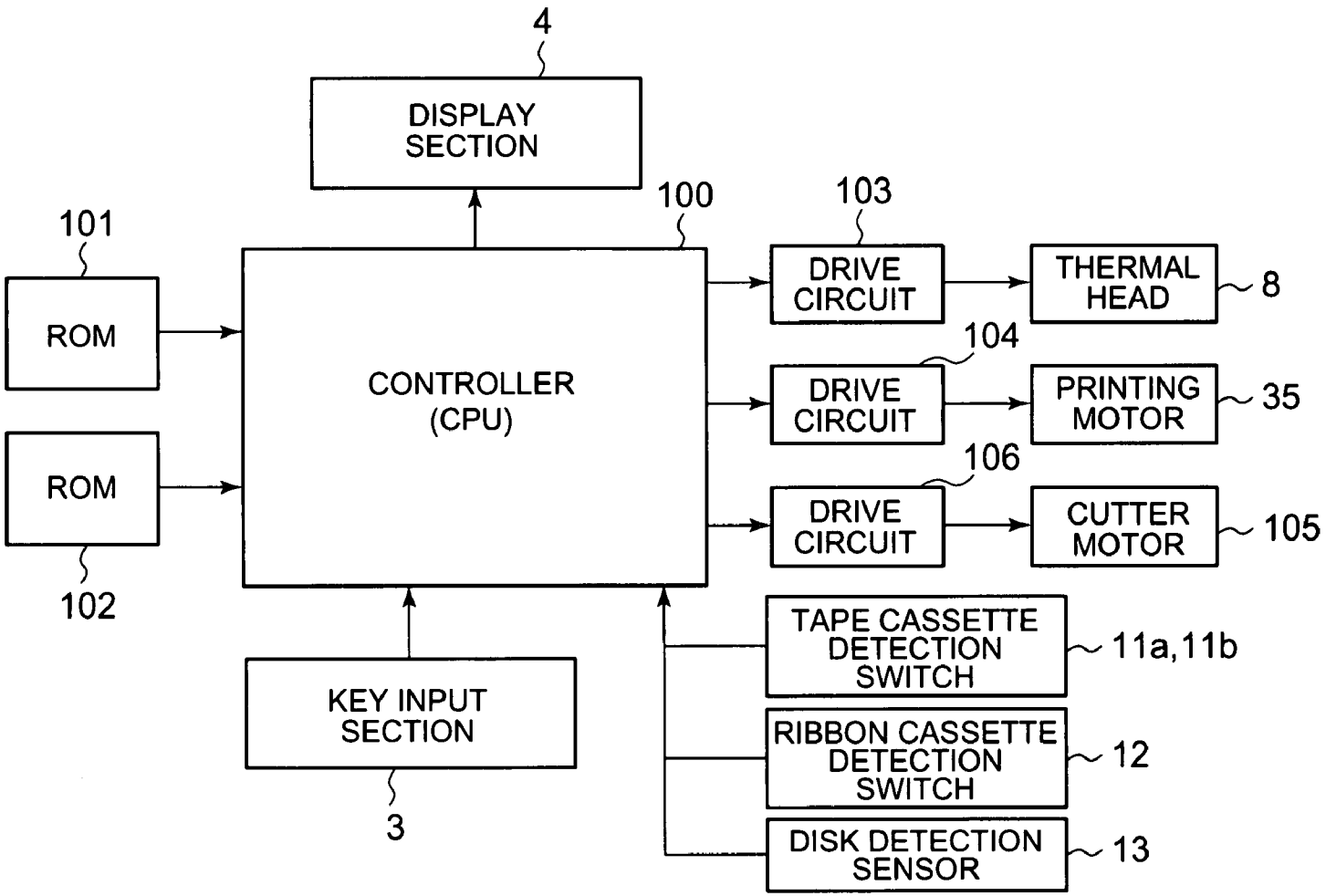
FIG. 20 is a block diagram showing the structure of an electronic circuit of the printing apparatus.

FIG. 20 is a block diagram showing the electronic circuit of the printing apparatus P according to the embodiment. The printing apparatus P has a controller (CPU) 100, which performs the general control of the printing apparatus P. The printing apparatus P also has a ROM 101 and a RAM 102.

Stored in the ROM 101 is program data, such as a system program for controlling the operations of the individual sections of the printing apparatus P. Also stored in the ROM 101 is data on an energization time table which set times for energizing the heat generating elements of the thermal head 8 according to the tape print mode to print on a table and the disk print mode to print on an optical disk D.

The RAM 102 has memories including an input data memory for storing input data, and a print data memory for storing print pattern data, and temporarily stores data needed for the printing operation.

The key input section 3 and the display section 4 are connected to the controller 100. Further connected to the controller 100 are a drive circuit 103, which drives the thermal head 8, a drive circuit 104, which drives the printing motor 35, and a drive circuit 106, which drives the cutter motor 105. The tape cassette detection switches 11*a* and 11*b*, the ink ribbon cassette detection switch 12 and the disk detection sensor 13 are also connected to the controller 100.

Figure 21:
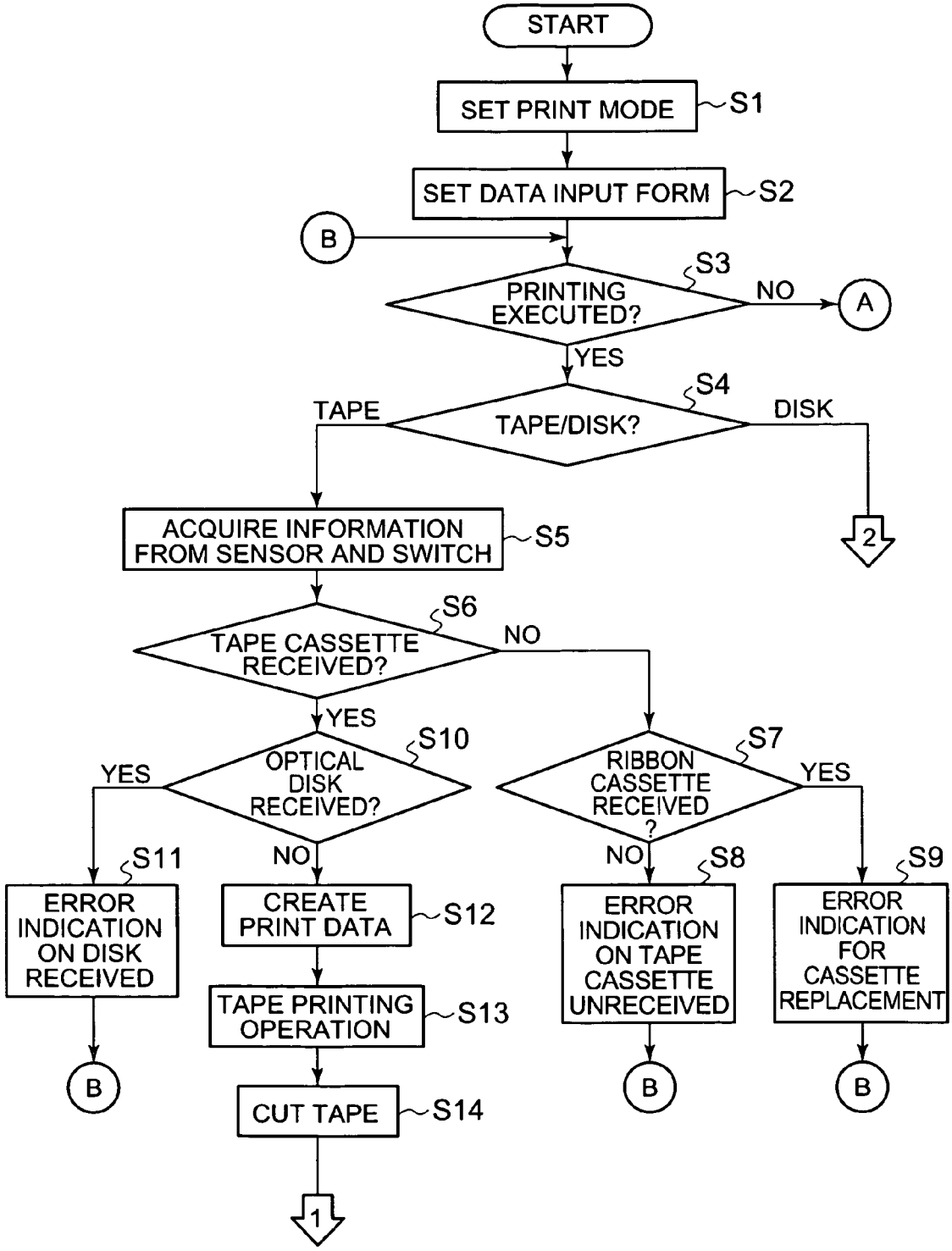
FIG. 21 is a flowchart illustrating a part of the operational flow of the printing apparatus.
Figure 22:
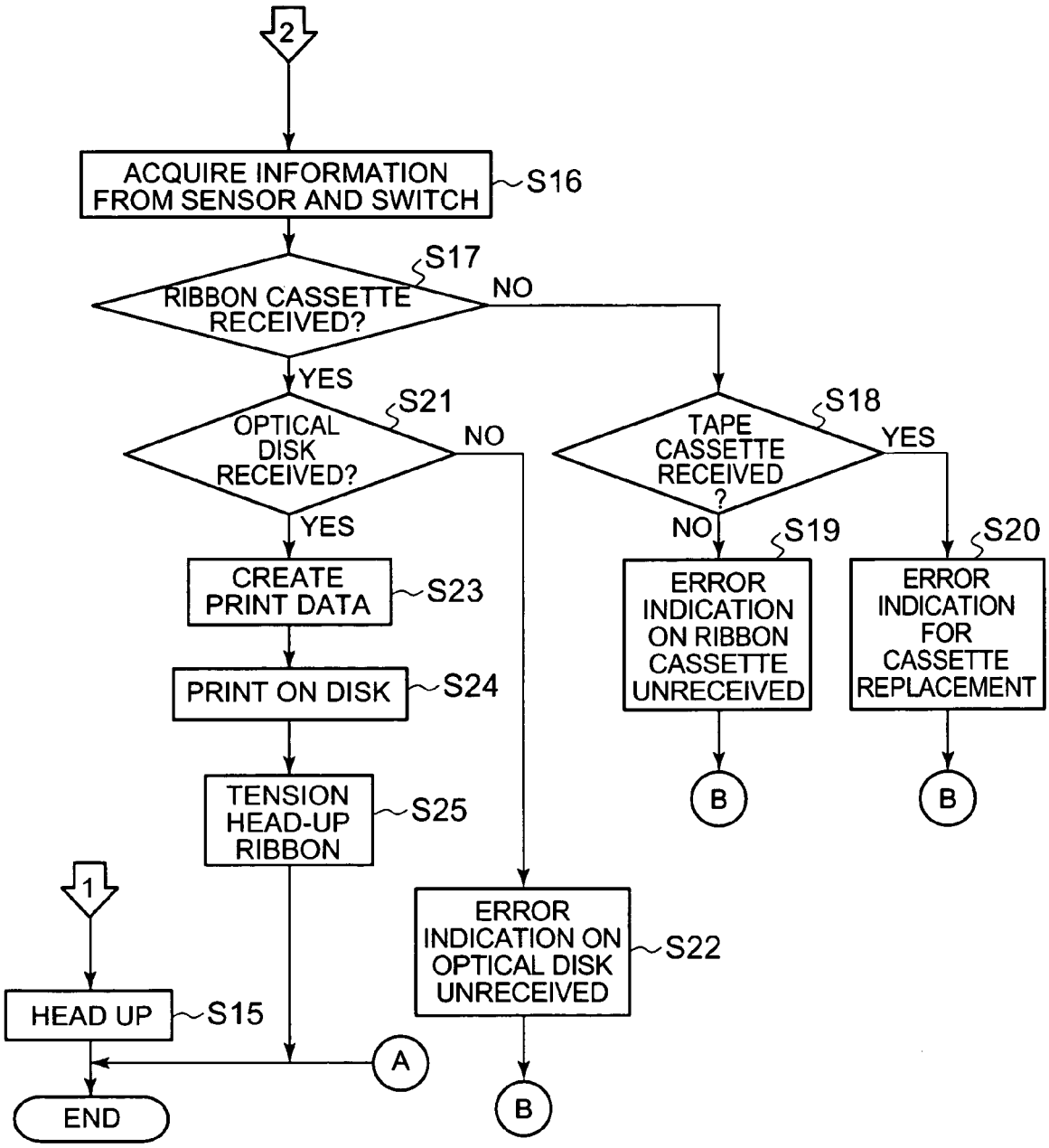
FIG. 22 is a flowchart illustrating a part of the remaining operational flow of the printing apparatus.

Next, the printing operation of the printing apparatus P will be explained. FIGS. 21 and 22 are flowcharts illustrating the flow of the print control of the printing apparatus P.

First, a menu screen for setting the tape print mode with the print tape 71 as the print target or the disk print mode with the optical disk D as the print target is displayed on the display section 4, and a user sets the print mode through the menu screen (step S1).

Next, the display section 4 displays an input edition screen and a form setting screen, and the user enters data to be printed through the key input section 3, and performs the input setting of a form, such as a character size, a linage, and a font. (step S2).

Subsequently, the controller 100 determines whether or not the execution of printing has been instructed (step S3). When the user has instructed the execution of the printing through the operation of the print key of the key input section 3, (step S3: YES), the controller 100 determines whether the set print mode is for the print tape or the optical disk (step S4). If the user instructs the termination of printing through the operation of a cancel key or the like, the controller 100 terminates the process (step S3: NO and END).

When having determined that the tape print mode has been set at the step S4, the controller 100 acquires information from the tape cassette detection switches 11*a* and 11*b*, the ink ribbon cassette detection switch 12, and the disk detection sensor 13 all provided at the receiving section 6 (step S5), and determines whether or not the tape cassette 70 is received in the receiving section 6 (step S6).

When having determined that the tape cassette 70 is not received in the receiving section 6 (step S6: NO), the controller 100 then determines whether or not the ink ribbon cassette is received in the receiving section 6 (step S7). When having determined that the ink ribbon cassette 85 is not received in the receiving section 6 (step S7: NO), the controller 100 displays an error indication that the tape cassette 70 is not received on the display section 4 (step S8), and the flow stands by for the instruction to execute printing at the step S3. During this shifting, the user can put the tape cassette 70 in the receiving section 6 and instruct the execution of printing again.

When having determined that the ink ribbon cassette 85 is received in the receiving section 6 (step S7: YES), the controller 100 displays an error indication that the tape cassette 70 should be set instead of the ink ribbon cassette 85 on the display section 4 (step S9), and the flow stands by for the instruction to execute printing at the step S3. This allows the user to replace the ink ribbon cassette 85 received in the receiving section 6 with the tape cassette 79, and instruct the execution of printing again.

When having determined that the tape cassette 70 is received in the receiving section 6 (step S6: YES), the controller 100 determines whether or not the optical disk D is received in the receiving section 6 (step S10). When having determined that the optical disk D is received in the receiving section 6 (step S10: YES), the controller 100 displays an error indication that the optical disk D should be removed since the optical disk is received on the display section 4 (step S11), and the flow stands by for the instruction to execute the printing at the step S3. This permits the user to remove the optical disk D received in the receiving section 6 and instruct the execution of the printing again.

When having determined that the tape cassette 70 is received in the receiving section 6 (step S6: YES) and the optical disk D is not received in the receiving section 6 (step S10: NO), the controller 100 creates print data of the input data based on tape cassette information such as the set format and the width of the captured tape (step S12). The controller 100 drives the printing motor 35, to carry out the movement of the thermal head 8 toward the print position, explained referring to FIG. 14, and the rotation of the platen roller 7 and ribbon winding shaft 9, explained referring to FIG. 15, thereby feeding the print tape 71 and the ink ribbon 72 overlapping each other, and to drive the heating elements of the thermal head 8 to generate heat according to the print data, thereby thermally transferring the ink of the ink ribbon 72 onto the print tape 71 to do printing (step S13).

After the printing is finished, the cutting mechanism 17 is driven by the cutter motor 105 with the thermal head 8 pressed against the platen roller 7, and the movable blade 17*b* is operated to cut the print tape 71 (step S14). Further, as discussed referring to FIG. 16, the printing motor 35 is driven reversely to separate the thermal head 8 from the platen roller 7 (head-up), and then terminates the process (step S15, and END).

When it is determined at the step S4 that the set print mode is the disk print mode, the controller 100 acquires the information from the tape cassette detection switches 11*a*, 11*b*, the ink ribbon cassette detection switch 12, and the disk detection sensor 13, all provided at the receiving section 6 (step S16), and then determines whether or not the ink ribbon cassette 85 is received in the receiving section 6 based on the information from the ink ribbon cassette detection switch 12 (step S17).

When having determined that the ink ribbon cassette 85 is not received in the receiving section 6 (step S17: NO), the controller 100 then determines whether or not the tape cassette 70 is received in the receiving section 6 (step S18). When having determined that the tape cassette 70 is not received in the receiving section 6 (step S18: NO), the controller 100 displays an error indication that the ink ribbon cassette 85 is not received in the receiving section 6 on the display section 4 (step S19), and the flow stands by for the instruction to execute printing at the step S3. This error indication permits the user to put the ink ribbon cassette 85 in the receiving section 6 and instruct the execution of printing again.

When having determined that the tape cassette 70 is received in the receiving section 6 (step S18: YES), the controller 100 displays an error indication that the tape cassette 70 should be replaced with the ink ribbon cassette 85 on the display section 4 (step S20), and the flow stands by for the instruction execute the printing at the step S3. This permits the user to replace the tape cassette 70 received in the receiving section 6 with the ink ribbon cassette 85, and instruct the execution of printing again.

When having determined that the ink ribbon cassette 85 is received in the receiving section 6 (step S17: YES), the controller 100 then determines whether or not the optical disk D is received in the receiving section 6 (step S21). When having determined that the optical disk D is not received in the receiving section 6 (step S21: NO), the controller 100 displays an error indication indicating that the optical disk D is unreceived in the receiving section 6 (step S22), and the flow stands by for the instruction to execute printing at the step S3. This allows the user to put the optical disk D in the receiving section 6 and instruct the execution of the printing again.

When having determined that the ink ribbon cassette 85 is received in the receiving section 6 (step S17: YES), and the optical disk D is received in the receiving section 6 (step S21: YES), the controller 100 creates the print data of data input based on the set form (step S23), drives the printing motor 35 in the forward direction to move the thermal head 8 toward the print position as illustrated in FIG. 14, and to rotate the platen roller 7 and the ribbon winding shaft 9 as illustrated in FIG. 15, thereby feeding the optical disk D and the ink ribbon 87 overlapping each other, and to drive the heating elements of the thermal head 8 is so driven as to generate heat according to the print data, thereby thermally transferring the ink of the ink ribbon 87 onto the label side of the optical disk D to do printing (step S24).

When the printing is finished, the optical disk D is carried to the position of the ejection section 14, and halted in a state where more than or equal to the half of the area portion on the upper side of the carrying direction is supported above the ejection section 14. Next, as explained referring to FIGS. 16 and 17, the printing motor 35 is reversely driven, thereby separating the thermal head 8 from the platen roller 7, and the printing motor 35 is reversely driven for a predetermined time to tension the ink ribbon 87, after which the process is terminated (step S25, and END).

In the embodiment, regarding the tape cassette 70 and the ink ribbon cassette 85 both used selectively, as the contour of the tape cassette 70 and that of the ink ribbon cassette 85 are designed identical, it is possible to position both of them at a predetermined position in the receiving section 6 and put them in.

Figure 23A:
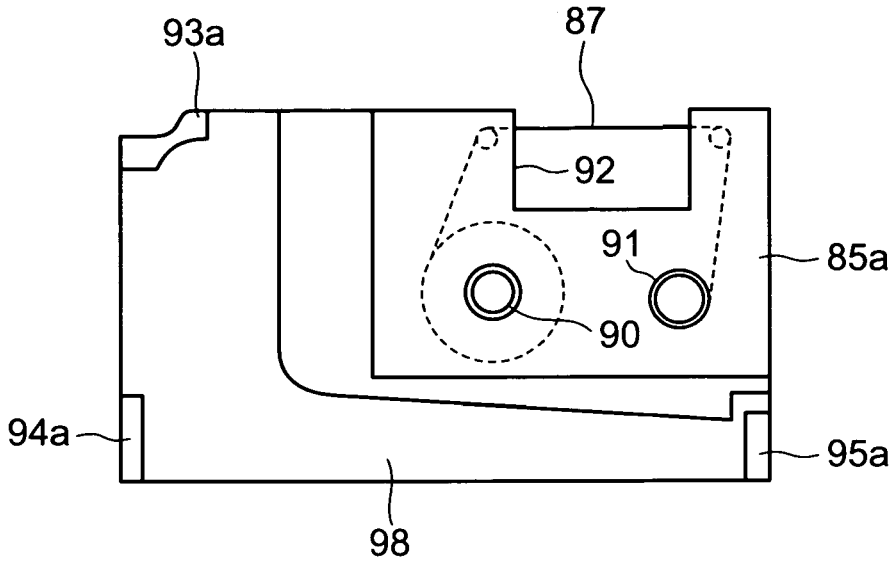
FIG. 23A is a plan view of a modification of the ink ribbon cassette.
Figure 23B:
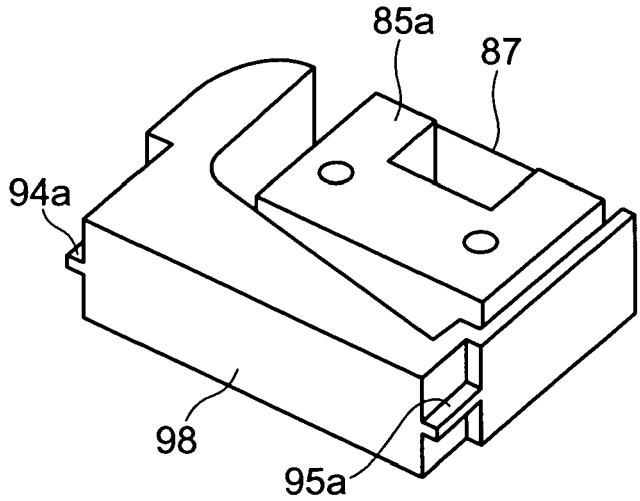
FIG. 23B is a perspective view of the modification of the ink ribbon cassette.

However, since the ink ribbon cassette 85 does not hold the print tape like the tape cassette 70, the ink ribbon cassette 85 can be structured smaller in size as illustrated in FIG. 23. In this case, however, since the shape of an ink ribbon cassette 85*a* becomes smaller, this cassette cannot be positioned at the predetermined position in the receiving section 6 even if the user attempts to directly place this cassette in the receiving section 6. Accordingly, an adapter 98 with approximately the same contour as that of the tape cassette 70 is used in this case. The small ink ribbon cassette 85*a* is mounted in the adapter 98, and put together in the receiving section 6. Like the ink ribbon cassette 85 illustrated in FIG. 5, the adapter 98 is provided with to-be-supported portions 93*a*, 94*a*, and 95*a* which correspond to the support stages 10*a*, 10*b*, and 10*c*. The to-be-supported portions 93*a*, 94*a*, and 95*a* have the same shapes, and the same functions as the to-be-supported section 93, 94, and 95 of the ink ribbon cassette 85.

In the embodiment, while the reception of the optical disk D at the predetermined reception position and the positioning of the optical disk D at the print start position are carried out on the basis of the information from the single disk detection sensor 13 provided at the central portion of the guide section 15, two sensors may be provided with those two functions respectively. As illustrated in FIG. 10A, a sensor 13*a* may be added on adjacent to the lower sides of the platen roller 7 and thermal head 8. In this case, the disk detection sensor 13 has a function for checking whether the optical disk D is received in the predetermined reception position, and the sensor 13*a* has a function for positioning the optical disk D at the print start position. As illustrated in FIG. 10A, with the optical disk D received at the initial reception position, the sensor 13*a* is located in the vicinity of the downstream side of the outer periphery of the optical disk D. The sensor 13*a* comprises, for example, a reflective optical sensor. In the state illustrated in FIG. 10A, the output of the disk detection sensor 13 is at a low level, and the output of the sensor 13*a* is also at a low level. Based on the combination of those information, the reception of the optical disk D at the initial reception position is determined. When printing is started and the optical disk is fed downstream, the optical disk D is not located at the position of the disk detection sensor 13, making the output of that sensor at a high level. As the optical disk D moves at the position of the sensor 13*a*, the output of the sensor 13*a* becomes a high level when the periphery edge of the optical disk D reaches the position. Based on the information from the two sensors, it is possible to control the timing of starting printing on the optical disk D.

Figure 24A:
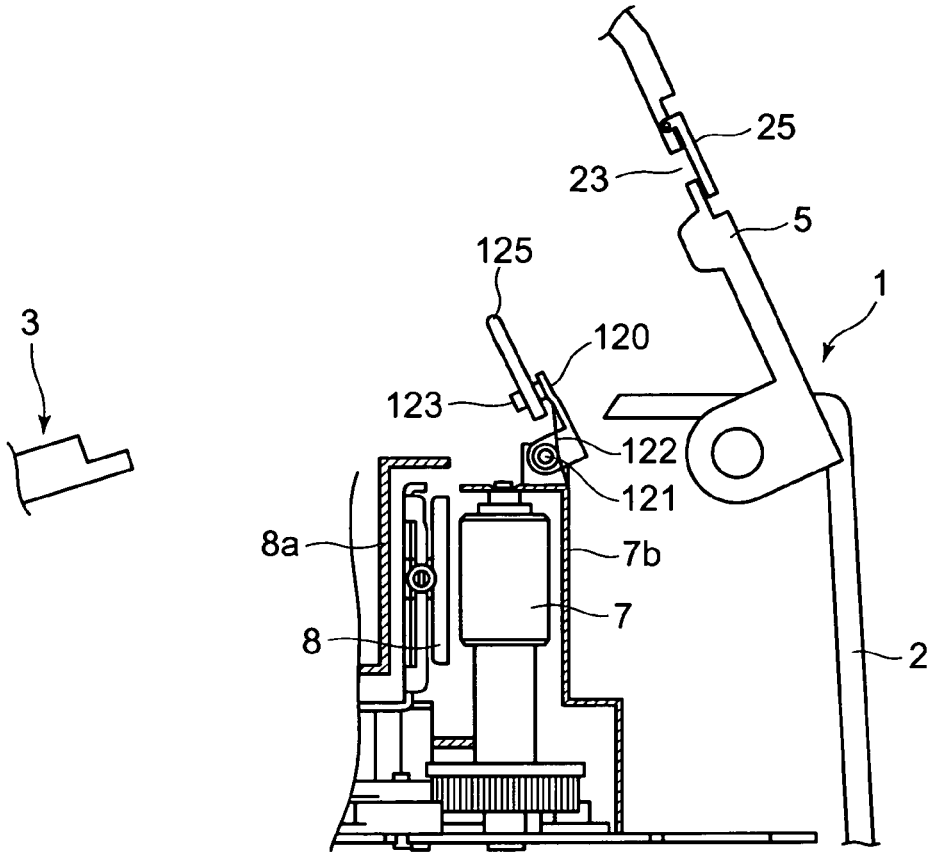
FIG. 24A is a diagram showing the structure of a modification of an insertion-prevention section for an optical disk.
Figure 24B:
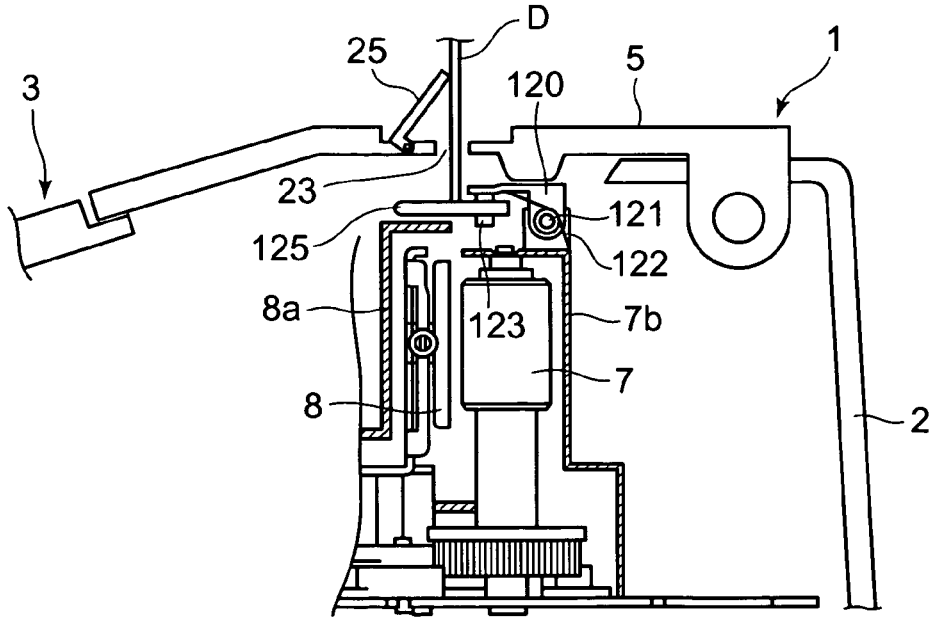
FIG. 24B is a diagram illustrating prevention of insertion of an optical disk into the main body of the printing apparatus according to the modification.

FIGS. 24A and 24B illustrate another example of the insertion prevention section which prevents the accidental insertion of the optical disk D through the ejection port 23 from above. In this example, a rotation frame 120 is provided above an attachment frame 7*a* which covers the upper surface of the platen roller 7. The rotation frame 120 is rotatably supported by a shaft 121 in the up and down direction, and is elastically urged upward by a spring 122.

Figure 25:
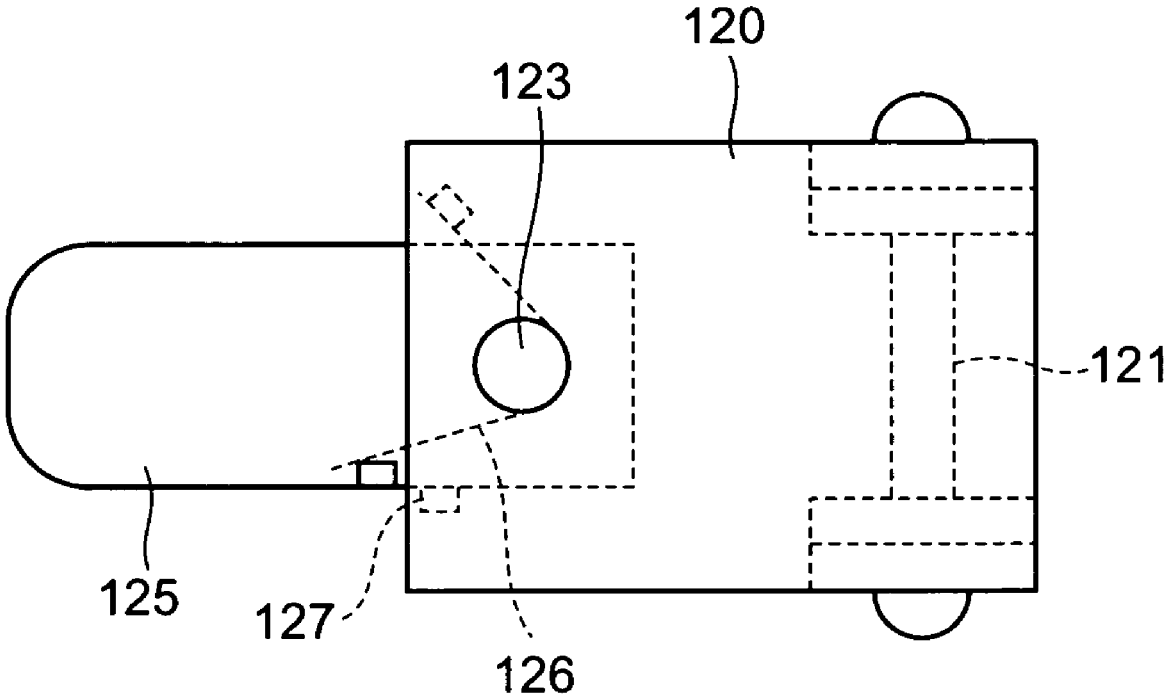
FIG. 25 is a plan view of the essential portion of the modification.

A cover piece 125 is attached to the rotation frame 120 via a shaft 123. The cover piece 125 is rotatably attached to the shaft 123, and is elastically urged toward the counterclockwise direction in FIG. 25 via a spring 126. The rotation range of the cover piece 125 is regulated within a predetermined range by a stopper 127. The rotation range of the rotation frame 120 which is elastically urged by the spring 122 is regulated within a predetermined range by a non-illustrated stopper.

As illustrated in FIG. 24A, when the receiving-section cover 5 of the main body 1 is opened, the rotation frame 120 is rotated upward together with the cover piece 125 by force of the spring 122, tilts obliquely upward, and leaves from a space above the clearance between the platen roller 7 and the thermal head 8, thereby that space is opened.

In this state, the tape cassette 70 illustrated in FIG. 4 and the ink ribbon cassette 85 illustrated in FIG. 5 are to be received in the receiving section 6 of the main body 1. At this time, because the space above the clearance between the platen roller 7 and the thermal head 8 is opened, the print tape 71 of the tape cassette 70 and the ink ribbon 72, or the ink ribbon 87 of the ink ribbon cassette 85 can be inserted into the clearance.

At the time of taking out the tape cassette 70 of the ink ribbon cassette 85 from the receiving section 6, the print tape 71 of the tape cassette 70 and the ink ribbon 72, or the ink ribbon 87 of the ink ribbon cassette 85 can be pulled out from the clearance.

In contrast, as illustrated in FIG. 24B, when the receiving-section cover 5 is closed, the rotation frame 120 is pressed by the receiving-section cover 5 at the time of closing that cover, the rotation frame 120 rotate downwardly together with the cover piece 125 against force of the spring 122, and comes to a horizontal state, and the cover piece 125 is positioned at the space above the clearance between the platen roller 7 and the thermal head 8, thereby covering the clearance.

Accordingly, even if the insertion of the optical disk D through the ejection port 23 of the receiving-section cover 5 from above the main body 1 in that state is attempted, the optical disk D hits the cover piece 125, inhibiting the insertion of the optical disk D. This can prevent the insertion of the optical disk D from a wrong direction.

When the optical disk D is inserted from the correct direction, that is, through the opening 16 (insertion port) at the side of the main body 1, the insertion-side periphery of the optical disk D comes in contact with the side of the cover piece 125 in accordance with the insertion of the optical disk D. The cover piece 125 rotates in the clockwise direction in FIG. 25 against the force of the spring 126, and the cover piece 125 leaves the space above the clearance between the platen roller 7 and the thermal head 8 by that rotation. This permits the insertion of the optical disk D to the initial position in the main body 1.

At this time, the optical disk D is inserted while facing in a direction parallel to the feed direction of the ink ribbon 87, resulting in the smooth insertion of that disk without twisting and damaging the ink ribbon 87.

Figure 26:
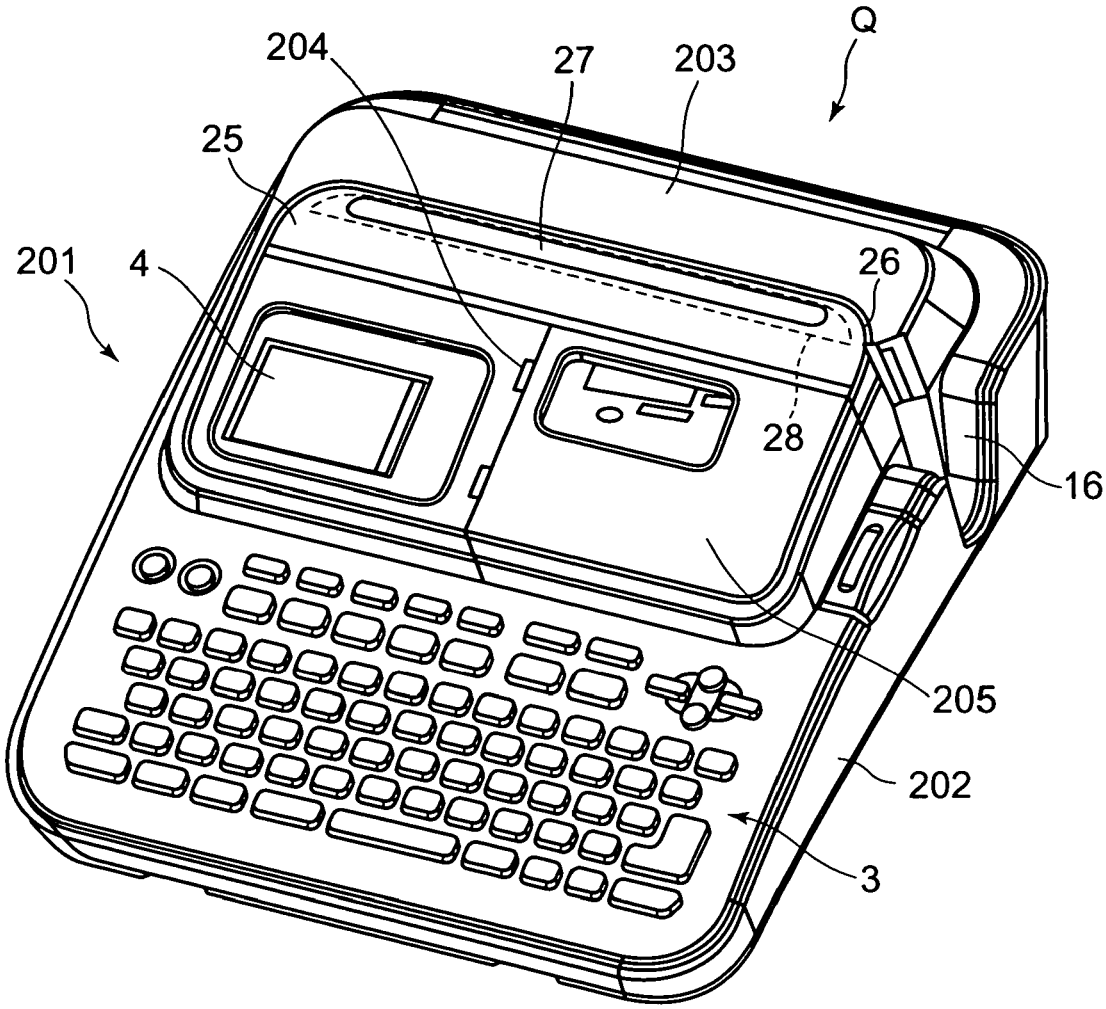
FIG. 26 is a perspective view of a printing apparatus according to another embodiment of the invention.

Next, FIG. 26 is a perspective view of a printing apparatus according to another embodiment of the invention.

A printing apparatus Q comprises a main body 201 which has a body case 202, an upper case 203 fixed and provided on the body case 202, and a receiving-section cover 205 which is rotationally provided on the upper case 203 by a hinge 204 and covers the receiving section. The printing apparatus Q has the same structure as that of the printing apparatus P except that the structure of the main body 201 partially differs from that of the main body 1. That is, the printing apparatus Q is provided with the openable and closable receiving-section cover 205 only at a position of covering the upper portion of the receiving section of the body case 202 which receives the ink ribbon cassette 85 and the tape cassette 70 therein. Therefore, the ejection port 23, the ejection-port cover 25, and the insertion prevention section illustrated in FIGS. 11 and 12 are provided on the upper case 203 which is securely provided on the body case 202. The same structural portions as those of the printing apparatus P are denoted by the same reference numerals. The printing apparatus Q, if provided with the insertion prevention section as illustrated in FIGS. 11, 12, 24A, 24B, and 25, can demonstrate the same effect as that of the printing apparatus P.

Although the explanation has been given of the printing apparatus of the type that moves the printing tape 71 or the optical disk D in the print direction with the thermal head 8 fixed, the present invention can be applied to a printing apparatus of a type which moves the thermal head with the print target fixed.

INDUSTRIAL APPLICABILITY

As explained above, according to the invention, it is possible to provide the printing apparatus which has the main body provided with the insertion port into which a recording medium is inserted only in a direction parallel to the feed direction of the ink ribbon, thereby avoiding troubles, such as twisting and damaging of the ink ribbon by the recording medium at the time the recording medium is inserted.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2004-299323 filed on Oct. 13, 2004 and Japanese Patent Application No. 2005-283526 filed on Sep. 29, 2005 and including specification, claims, drawings and summary. The disclosures of the above Japanese Patent Applications are incorporated herein by reference in their entireties.

What is claimed is:

1. A printing apparatus comprising:

a main body into which a print target is inserted;

a printing section, provided in the main body, which thermally transfers ink of an ink ribbon onto the print target;

a feeder, provided in the main body, which feeds the printing section with the ink ribbon;

wherein the main body has an insertion port which aligns a print surface of the print target with an ink surface of the ink ribbon from outside the main body toward the printing section therein, and into which the print target is insertable only in a direction parallel to a feed direction of the ink ribbon by the feeder;

wherein a guide section is provided in the main body, and the guide section aligns the print surface of the print target inserted into the main body via the insertion port with the ink surface of the ink ribbon, holds the print target in the direction parallel to the feed direction, and guides the print target to a position at which the printing section is provided; and wherein the main body is provided with:

an ejection port from which the print target inserted into the main body is ejectable out of the main body in a direction orthogonal to the feed direction; and an insertion-prevention section which prevents insertion of the print target from outside the main body into the main body through the ejection port.

2. The printing apparatus according to claim 1, wherein the ejection port is formed in a slit-like shape along a direction of the guide section, and the insertion-prevention section is provided in the main body along the ejection port.

3. The printing apparatus according to claim 1, wherein the ejection port is formed in a slit-like shape along the guide section, and the insertion-prevention section is provided at least at in a vicinity of the position at which the printing section is provided.

4. The printing apparatus according to claim 1, wherein the insertion-prevention section is pushed by the print target to be withdrawn to a position where the insertion-prevention section does not interfere with the insertion of the print target into the main body when the print target is inserted via the insertion port, and the insertion-prevention section returns to a state in which the insertion of the print target through the ejection port is prevented when the print target is ejected from the main body.

5. The printing apparatus according to claim 1, wherein the main body has a receiving section which detachably contains an ink-ribbon cassette holding the ink ribbon and contains the print target inserted into the main body such that the print target protrudes outward from the main body, wherein the ejection port is connected to the insertion port, and is provided with an ejection-port cover which covers an opening of the ejection port in an openable and closable manner, and wherein the ejection-port cover is opened when pressed by the print target to permit the print target to protrude from the main body through the ejection port when the print target is inserted via the insertion port and contained by the receiving section, and the ejection-port cover returns to a closed state when the print target is ejected out of the main body.

6. The printing apparatus according to claim 5, wherein the main body has a receiving-section cover which covers an opening of the receiving section in an openable and closable manner, and wherein the receiving-section cover comprises the ejection port, the ejection-port cover, and the insertion-prevention section.

7. The printing apparatus according to claim 5, wherein the ejection-port cover covers the print surface of the print target protruding outward from the main body when the print target is inserted into the main body and the ejection-port cover is opened.

8. The printing apparatus according to claim 7, wherein the ejection-port cover is made of a transparent material.

9. The printing apparatus according to claim 7, wherein the ejection-port cover has an alignment mark for adjusting a print position for the print target by the printing section.

10. The printing apparatus according to claim 7, wherein a portion of the ejection-port cover which contacts the print target is provided with a buffer member.

* * * * *